US006417439B2

(12) United States Patent
Uehara et al.

(10) Patent No.: US 6,417,439 B2
(45) Date of Patent: Jul. 9, 2002

(54) ELECTRONIC SYNCHRONIZER FOR MUSICAL INSTRUMENT AND OTHER KIND OF INSTRUMENT AND METHOD FOR SYNCHRONIZING AUXILIARY EQUIPMENT WITH MUSICAL INSTRUMENT

(75) Inventors: Haruki Uehara; Shinya Koseki, both of Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/754,520

(22) Filed: Jan. 4, 2001

(30) Foreign Application Priority Data

Jan. 12, 2000 (JP) ..... 2000-003953
Jan. 12, 2000 (JP) ..... 2000-003955

(51) Int. Cl.[7] ..... G10H 7/00

(52) U.S. Cl. ..... 84/645; 84/464 R; 362/85; 362/233

(58) Field of Search ..... 84/645, 464 R, 84/464 A; 362/85, 233, 234

(56) References Cited

U.S. PATENT DOCUMENTS 5,266,732 A * 11/1993 Suzuki
5,270,480 A 12/1993 Hikawa
5,406,176 A * 4/1995 Sugden
5,461,188 A * 10/1995 Drago et al.
5,768,122 A * 6/1998 Motoc
5,769,527 A * 6/1998 Taylor et al.
5,940,167 A * 8/1999 Gans
5,986,201 A * 11/1999 Starr et al. ..... 84/645
6,029,122 A * 2/2000 Hunt

FOREIGN PATENT DOCUMENTS

JP 10-69215 3/1998

* cited by examiner

*Primary Examiner*—Jeffrey Donels
(74) *Attorney, Agent, or Firm*—Morrison & Foerster

(57) ABSTRACT

An electronic synchronizer stores MIDI music data codes in a principal melody track and other MIDI music data codes in an external control track, and compares music data codes representative of depressed keys with the MIDI music data codes in the principal melody track to see whether or not the keys are timely depressed for producing the principal melody for reading out the other MIDI music data codes in the external control track in synchronism with the fingering, wherein the MIDI music data codes in the external control track are converted to instructions for an audio-visual system so that the electronic synchronizer achieves the synchronization between the fingering and the audio-visual system on the basis of the MIDI music data codes.

20 Claims, 21 Drawing Sheets

| TRACK | PART TO BE CONTROLLER |
|---|---|
| Tr0 | KEY ACTUATORS |
| Tr1 | TONE GENERATOR |
| Tr2 | AUDIO - VISUAL SYSTEM |
| ⋮ | ⋮ |
| Tr15 | NOT ASSIGNED |

Fig. 6

| NOTE NUMBER | FILE NAMES |
|---|---|
| 1 | LIGHTING 1001 |
| 0 | LIGHTING 1002 |
| 2 | LIGHTING 1003 |
| ⋮ | ⋮ |
| 65 | IMAGE 1909 |
| 66 | IMAGE 2001 |
| 67 | IMAGE 2002 |
| ⋮ | ⋮ |
| 125 | SOUND 3208 |
| 126 | SOUND 3209 |
| 127 | SOUND 3210 |

Fig 7

| NOTE NUMBER |
| --- |
| 65 |

Fig. 9A

| TRACK | EVENT | NOTE NUMBER | TARGET TIME |
| --- | --- | --- | --- |
| Tr0 | NOTE – ON | 67 | t8 |
| Tr2 | NOTE – ON | 67 | t8 |

Fig. 9B

| NOTE NUMBER | WAITING TIME | FLAG TIME |
| --- | --- | --- |
| 67 | 2 | t8 |

Fig. 9C

| NOTE NUMBER |
| --- |
| 65 |

Fig. 19A

| TRACK | EVENT | NOTE NUMBER | TARGET TIME |
| --- | --- | --- | --- |
| Tr0 | | 67 | t8 |
| Tr2 | | 67 | t8 |

Fig. 19B

| NOTE NUMBER | WAITING TIME | FLAG TIME |
| --- | --- | --- |
| 67 | 2 | t8 |

Fig. 19C

ELECTRONIC SYNCHRONIZER FOR MUSICAL INSTRUMENT AND OTHER KIND OF INSTRUMENT AND METHOD FOR SYNCHRONIZING AUXILIARY EQUIPMENT WITH MUSICAL INSTRUMENT

FIELD OF THE INVENTION

This invention relates to a synchronizer and a controlling method used therein and, more particularly, to a synchronizer between a musical instrument and another kind of instrument and a method used therein.

DESCRIPTION OF THE RELATED ART

Playing music is enjoyable by the player. However, all the players get a lot of fun through an ensemble. If another musical instrument is automatically performed in synchronism with a musical instrument, the player can get a lot of fun through the ensemble without another player. Moreover, a visual effect such as stage lighting enhances the musicality of a performance. However, if the stage lighting is improperly varied with the music passage, the performance may be damaged. The synchronization between the musical instrument and the lighting apparatus is required. In case where a performance is to be recorded, a recording system is used, and the synchronization is required for a smooth recording. If the recording system starts the recording after the initiation of a performance, a passage is lost in the performance stored in a recording medium. When a musical instrument plays an ensemble with a chorus already recorded, the playback is to be synchronous with the musical instrument. Thus, a musical instrument requires a synchronizer.

A human being may serve as the synchronizer in a concert. Professional players may synchronize with the conductor. However, beginners can not properly follow the conductor. An electronic musical instrument is equipped with an electronic synchronizer. The prior art electronic synchronizer assists the beginner in the training. While the trainee is playing a part of a tune on the electronic musical instrument, the electronic synchronizer reads a different part of the score from an information storage medium, and controls an electronic sound generator to generate a series of tones in the part. It is not easy for the beginner to exactly trace a score. The beginner is liable to be out of tune with the score. In this situation, the prior art electronic synchronizer controls the progression of the part assigned to the electronic sound generator, and makes the electronic sound generator synchronous with the fingering of the trainee.

In detail, the prior art electronic synchronizer is associated with an electronic keyboard musical instrument. A series of music data codes for the accompaniment is stored for the prior art electronic synchronizer, and a cue flag is stored in particular music data codes together with the note numbers to be generated, respectively. While a trainee is playing a tune, the prior art electronic synchronizer monitors his depressed keys, and compares the notes assigned to the depressed keys with the notes represented by the music data codes. The electronic keyboard musical instrument generates the tones for the accompaniment as well as the tones designated by the trainee. If the trainee depresses the key represented by the particular music data code marked with the cur flag, the prior art electronic synchronizer allows the electronic keyboard musical instrument to continue the accompaniment. However, if the trainee have not depressed the key represented by the particular music data code marked with the cue flag, yet, the prior art electronic synchronizer instructs the electronic keyboard musical instrument to wait for the key represented by the particular music data code. When the trainee depresses the key represented by the particular music data code, the prior art electronic synchronizer permits the electronic keyboard musical instrument to proceed to the next passage of the accompaniment. Thus, the prior art electronic synchronizer regulates the accompaniment with the fingering of the trainee.

The cue flag serves as a mark at which the accompaniment is to be synchronized with the fingering on the keyboard. In other words, the cue flag is used for the synchronization between the fingering and only one musical instrument. Any other instrument is not taken into account. For this reason, the prior art electronic synchronizer is not available for the synchronization between more than two parts.

SUMMARY OF THE INVENTION

It is therefore an important object of the present invention to provide a synchronizer, which synchronizes a kind of instrument with a musical instrument on the basis of pieces of music data.

It is also an important object of the present invention to provide a method used in the synchronizer.

In accordance with one aspect of the present invention, there is provided a synchronizer for synchronizing a kind of instrument used for a purpose different from music with another kind of instrument used for producing a series of tones, and the synchronizer comprises a first data source storing a first piece of sequence data including pieces of synchronous data at intervals in a first data group and a second piece of sequence data including pieces of music data in a second data group and available for the another kind of instrument in order to produce another series of tones and synchronously outputting the first piece of sequence data and the second piece of sequence data, a second data source successively outputting pieces of reference data representative of an actual performance, a converter for converting the pieces of music data to instructions for tasks to be achieved by the kind of instrument, a first controller connected to the first data source, the second data source and the converter and comparing the pieces of synchronous data with certain pieces of reference data corresponding thereto for transferring the pieces of music data to the converter in synchronism with the certain pieces of reference data and a second controller connected to the converter and the kind of instrument, and driving the kind of instrument in response to the instructions.

In accordance with another aspect of the present invention, there is provided a method for synchronizing a kind of instrument used for a purpose different from music with another kind of instrument used for producing a series of tones, and the method comprises the steps of a) preparing a first piece of sequence data including pieces of synchronous data and stored at intervals in a first data group and a second piece of sequence data including pieces of music data, stored in a second data group and available for the another kind of instrument in order to produce another series of tones, b) receiving one of pieces of reference data, c) comparing the one of pieces of reference data with one of the pieces of synchronous data to see whether or not the one of pieces of reference data arrives within a predetermined time period around a target time when the one of the pieces of synchronous data is to be processed, d) transferring associated one of the pieces of music data to a converter in synchronism with the one of the pieces of reference data for converting the associated one of the pieces of music data to instructions for the kind of instrument when the answer in the step c) is given affirmative, e) controlling the kind of instrument in accordance with the instructions and f) repeating the steps b), c), d) and e) for each of the remaining pieces of reference data.

BRIEF DESCRIPTION OF THE DRAWINGS

The features and advantages of the synchronizer and the method will be more clearly understood from the following description taken in conjunction with the accompanying drawings in which:

FIG. 6 is a view showing a relation between tracks and parts to be controlled;

FIG. 7 is a view showing a relation between note numbers and file names in databases;

FIGS. 9A to 9C are views showing three buffers defined in a working memory of a host controller;

FIGS. 19A to 19C are views showing three buffers incorporated in a host controller;

DESCRIPTION OF THE PREFERRED EMBODIMENTS

First Embodiment

System Configuration

Figure 1:
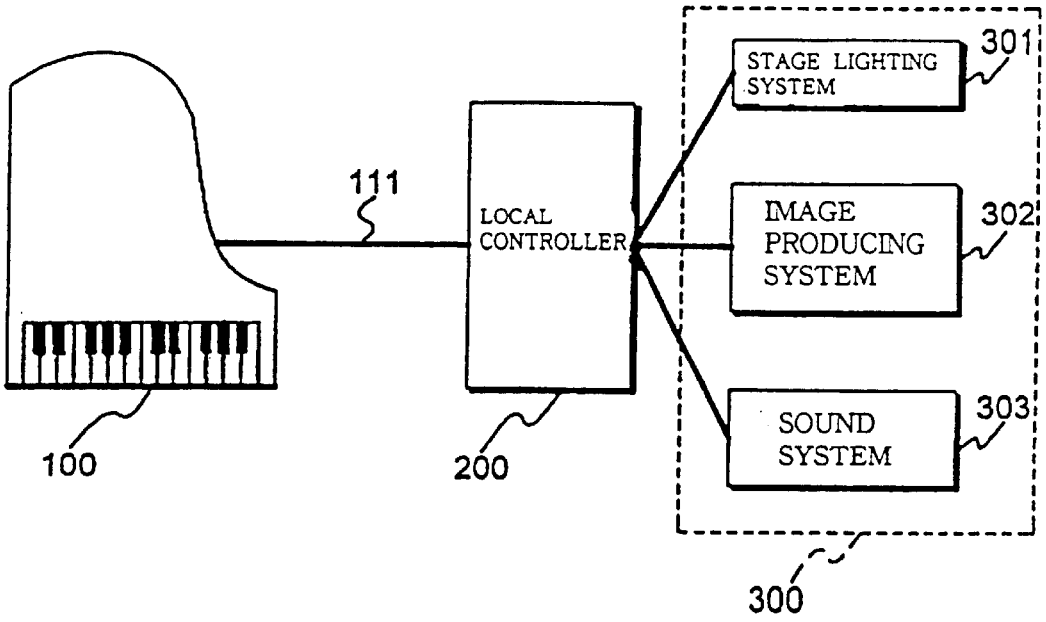
FIG. 1 is a block diagram showing an ensemble system according to the present invention.

Referring to FIG. 1 of the drawings, an ensemble system embodying the present invention comprises a keyboard musical instrument 100, a local controller 200 and an audio-visual system 300. The local controller 200 is connected between the keyboard musical instrument 100 and the audio-visual system 300. The keyboard musical instrument 100 has a MIDI (Musical Instrument Digital Interface) interface port 110 (see FIG. 2), and the MIDI interface port 110 is connected to the local controller 200 through a MIDI cable 111. The local controller 200 supplies control signals to the audio-visual system 300. While a pianist is playing a tune on the keyboard musical instrument 100, music data codes are supplied from the MIDI interface port 110 through the MIDI cable 111 to the local controller 200, and the local controller 200 analyzes the music data codes for controlling the audio-visual system 300. The keyboard musical instrument 100 supplies the music data codes in real time fashion to the local controller, and the audio-visual system 300 is synchronized with the keyboard musical instrument 100.

The audio-visual system 300 includes a stage lighting system 301, an image producing system 302 and a sound system 303, and the local controller 200 is connected in parallel to these components 301, 302 and 303. The stage lighting system 301 turns on and off, and moves the light beams on the stage under the control of the local controller 200. On the other hand, a static image or a moving picture is produced on a display incorporated in the image producing system 302, and the local controller 200 controls the image production with the control signal. The sound system 303 includes a compact disk controller, by way of example, and the local controller 200 controls sound effect produced by the sound system. These components 301/302/303 are independently synchronized with the keyboard musical instrument. Thus, more than two parts are synchronously controlled in the first embodiment.

Figure 2:
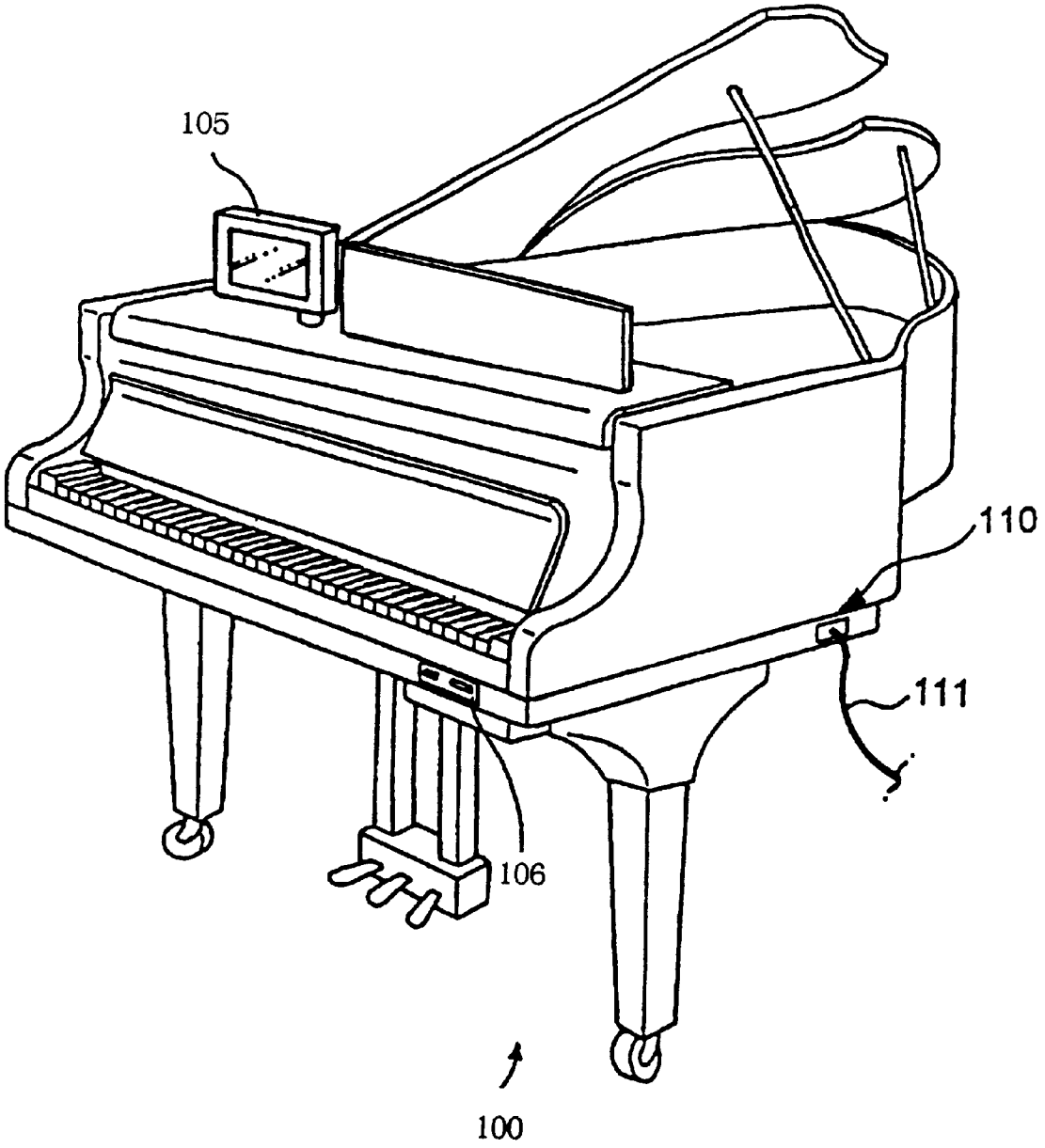
FIG. 2 is a perspective view showing a keyboard musical instrument forming a part of the ensemble system.
Figure 3:
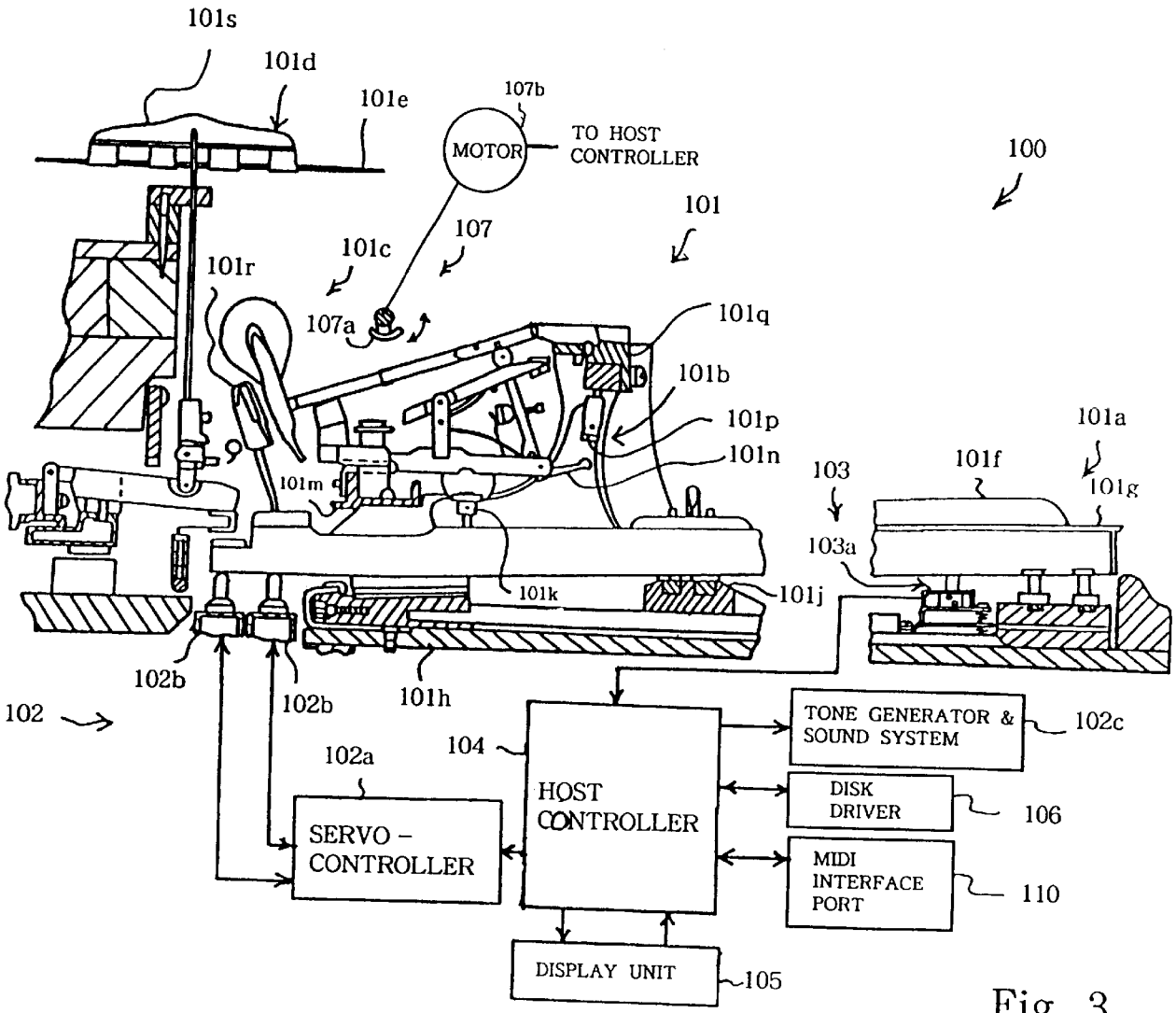
FIG. 3 is a cross sectional side view showing the keyboard musical instrument.

Turning to FIGS. 2 and 3 of the drawings, an automatic player piano serves as the keyboard musical instrument 100. The keyboard musical instrument 100 or the automatic player piano is broken down into an acoustic piano 101, a playback system 102, a recording system 103 and a silent system 107. A pianist plays a tune on the acoustic piano 101 through fingering. However, the playback system 102 plays a tune on the acoustic piano 101 without player's fingering. Otherwise, the playback system 102 reads out a set of music data codes representative of plural parts of a performance from an information storage medium such as, for example, a CD-ROM (Compact Disk Read Only Memory) disk or a DVD (Digital Versatile Disk), and synchronously controls the acoustic piano 100 and the audio-visual system 300. The set of music data codes may be supplied from the outside through the MIDI interface port 110. The recording system 103 produces a set of music data codes representative of a performance on the acoustic piano 101, and records the set of music data codes in a suitable information storage medium such as, for example, a CDR (Compact Disk Recordable) disk, a floppy disk or a magnetic disk. The recording system 103 can supply the set of music data codes through the MIDI interface port 110 to the local controller 200.

The acoustic piano 101 is similar to a standard grand piano, and includes a keyboard 101*a*, action mechanisms 101*b*, hammers 101*c*, damper mechanisms 101*d* and music strings 101*e*. These component parts 101*a* to 101*e* are linked with one another, and generate acoustic piano tones. In detail, black keys 101*f* and white keys 101*g* are laid on the well-known pattern, and form in combination the keyboard 101*a*. The notes of the scale are respectively assigned to the black/white keys 101*f*/101*g*. The keyboard 101*a* is mounted on a key bed 101*h*. The black/white keys 101*f*/101*g* are turnable around a balance rail 101*j*, and are held in contact with the associated action mechanisms 101*b* by means of capstan screws 101*k*.

The action mechanisms 101*b* are rotatable around a center rail 101*m*. Each of the action mechanisms 101*b* includes a jack 101*n* and a regulating button 101*p*. When the jack 101*n* is brought into contact with the regulating button 101*p*, the jack 101*n* escapes from the associated hammer 101*c*, and the hammer 101*c* is driven for rotation around a shank flange rail 101*q*.

The hammers 101*c* have rest positions under the associated music string 101*e*, respectively, and strike the music strings 101*e* for generating the acoustic piano tones. Upon striking the associated music strings 101*e*, the hammers 101*c* rebound, and return toward the rest positions. The rebounding hammer 103 is gently received by a back check 101*r* on the way to the rest position, and the back check 101*r* guides the hammer 101*c* to the rest position after the depressed key 101*f*/101*g* is released.

The damper mechanisms 101*d* have respective damper heads 101*s*, and are actuated by the black/white keys 11*f*/11*g*, respectively. The damper heads 101*s* are held in contact with the associated music strings 101*e*, and prevent the music strings 101*e* from resonance with a vibrating music string 101*e*. A pianist is assumed to depress a black/white key 101*f*/101*g*. The black/white key 101*f*/101*g* is sinking toward the end position, and pushing the associated damper mechanism 101*d* upwardly. The damper head 101*s* is spaced from the associated music string 101*e*, and the music string 101*e* is allowed to vibrate. Thereafter, the associated hammer 101*c* strikes the music string 101*e*. Thus, the component parts 101*a* to 101*d* are sequentially actuated for generating the acoustic piano tones as similar to the standard grand piano.

A host controller 104, a display unit 105, a disk driver 106 and the MIDI interface port 110 are shared between the playback system 102, the recording system 103 and the silent system 107 as will be hereinlater described in detail. A central processing unit, a program memory, a working memory and a data interface are incorporated in the host controller 104, and the central processing unit is communicable with other electric components as indicated by arrows in FIG. 3. The central processing unit produces a set of music data codes from key position signals and control signals from a set of music data information.

The display unit 105 is provided on the acoustic piano 101, and is located on the left side of the music rack. The display unit 105 has a data processing system, an image producing screen and a touch panel created on the image producing screen. The image producing screen may be implemented by a liquid crystal display panel. The image producing screen is three-dimensionally movable, and user can adjust the image producing screen to an arbitrary direction. Menus are stepwise shown on the touch panel, and user sequentially selects desired items on the touch panel. One of the menus prompts the user to select a mode of operation such as a playback mode, a recording mode, an acoustic sound mode, a silent mode and an ensemble mode. The display unit 105 further produces images representative of the selected mode and instructions for assisting the user.

The playback system 102 further comprises a servo-controller 102*a*, solenoid-operated key actuators 102*b* and a tone generator/sound system 102*c*. Though not shown in FIG. 3, plunger sensors are respectively provided in the solenoid-operated key actuators 102*b*, and plunger position signals representative of an actual plunger velocity are supplied from the plunger sensors to the servo-controller 102*a*.

A set of music data codes is supplied from the information storage medium or a suitable data source through the MIDI interface port 110. When the information storage medium such as, for example, a compact disk is placed on a tray of the disk driver 106, the disk driver 106 reads out a set of music data codes from the compact disk, and transfers the set of music data codes to the working memory of the host controller 104. The set of music data codes are representative of pieces of music data information, which include at least note numbers indicative of the black/white keys to be moved, a note-on time indicative of a time for generating a tone, a note-off time indicative of a time for decaying the tone and a key velocity to be imparted to the moved key. The key velocity represents the loudness of a tone to be generated, because the loudness of the tone is proportional to the key velocity.

When the user instructs the playback mode to the host controller 104, the host controller 104 starts an internal timer, and searches the set of music data codes to see whether or not any music data code is indicative of the present time. If the host controller 104 finds a music data code indicative of the note-on time equal to the present time, the host controller 104 determines a target trajectory for the black/white key 101*f*/101*g* to be moved and a target key velocity Vr on the target trajectory. The host controller 104 instructs the servo-controller 102*a* to control the solenoid-operated key actuator 102*b* associated with the black/white key 101*f*/101*g* along the target trajectory. The servo-controller 102*a* supplies a driving pulse signal to the solenoid-operated key actuator 102*b*. Then, the solenoid-operated key actuator 102*a* upwardly projects the plunger so as to move the associated black/white key 101*f*/101*g* without any fingering. While the plunger is projecting upwardly, the plunger sensor varies the plunger position signal, and the servo-controller 102*a* calculates an actual plunger velocity. The servo-controller 102*a* compares the actual plunger velocity with the target key velocity to see whether or not the plunger and, accordingly, the black/white key 101*f*/101*g* is moving along the target trajectory. If not, the servo-controller 102*a* varies the magnitude of the driving pulse signal for changing the plunger velocity and, accordingly, the key velocity. Thus, the black/white key 101*f*/101*g* is moved along the target trajectory identical with that in the original performance, and actuates the associated action mechanism 101*b* and the associated damper mechanism 101*d*. The damper head 101*s* is spaced from the music string 101*e*, and allows the music string 101*e* to vibrate. When the jack 101*n* is brought into contact with the regulating button 101*p*, the jack 101*n* escapes from the hammer 101*c*, and the hammer 101*c* is driven for rotation toward the music string 101*e*. The hammer 101*c* strikes the music string 101*e*, and rebounds thereon. The back check 101*r* gently receives the hammer 101*c*, and prevents the music string from double strike.

When the host controller 104 finds the music data code to represent the note-off time equal to the present time, the host controller 104 determines a target key velocity on a target trajectory of the released key, and instructs the servo-controller to decrease the magnitude of the driving pulse signal. The associated solenoid-operated key actuator 102*b* retracts the plunger, and guides the depressed black/white key 101*f*/101*g* toward the rest position. The servo-controller 102*a* controls the plunger through the feedback loop. The damper head 101*s* is brought into contact with the music string 101*e* at the note-off time, and the acoustic piano tone is decayed. The host controller 104 may control an ensemble between the solenoid-operated key actuators 102*b* and the tone generator 102*c*.

The recording system 103 further includes key sensors 103*a*. The key sensors 103*a* respectively monitor the black/white keys 101*f*/101*g*, and supply key position signals to the host controller 104. The key position signal is representative of the current key position of the associated black/white key 101*f*/101*g*. The key sensor 103*a* is implemented by a shutter plate and photocouplers. The shutter plate is attached to the back surface of the associated black/white key 101*f*/101*g*, and the photo-couplers are provided along the trajectory of the shutter plate at intervals. The photo-couplers radiate light beams across the trajectory of the shutter plate so that the shutter plate sequentially interrupts the light beams on the way to the end position.

The host controller 104 starts an internal clock for measuring the lapse of time from the initiation of the recording, and periodically checks the key position signals to see whether or not any one of the black/white keys 101*f*/101*g* changes the current position. When the host controller 104 finds a black/white key to be depressed, the host controller 104 specifies the note number assigned to the depressed black/white key 101*f*/101*g*, and determines the note-on time and the key velocity. The host controller 104 stores these pieces of music data information in a music data code. On the other hand, when the host controller 104 finds the depressed key to be released, the host controller 104 specifies the note number assigned to the released black/white key 101*f*/101*g*, and determines the note-off time and the key velocity. The host controller 104 stores these pieces of music data information in a music data code.

While the user is playing a tune on the keyboard 101*a*, the host controller 104 produces the music data codes for the depressed keys and the released keys. When the user finishes the performance, a set of music data codes is left in the working memory. The host controller 104 instructs the disk driver 106 to write the set of music data codes into the information storage medium.

The silent system 107 further comprises a hammer stopper 107*a* and an electric motor 107*b*, and the electric motor 107*b* is bi-directionally driven for rotation by the host controller 104. The host controller 104 changes the hammer stopper 107*a* from a free position to a blocking position by means of the electric motor 107*b*. When a pianist wants to generate the acoustic piano tones in the acoustic sound mode, the host controller 104 changes the hammer stopper 107*a* to the free position. Then, the hammer stopper 107*a* is vacated from the trajectories of the hammers 101*c*, and the hammers 101*c* are allowed to strike the associated music strings 101*e*. On the other hand, when the pianist wants to play a tune without any acoustic piano tone in the silent mode, the host controller 104 changes the hammer stopper 107*a* to the blocking position. Even though the hammers 101*c* are driven for rotation through the escape, the hammers 101*c* rebound on the hammer stopper 107*a* before striking the music strings 101*e*, and any acoustic piano tone is not generated from the music string 101*e*.

When the user selects the silent mode, the host controller 104 changes the hammer stopper 107*a* to the blocking position. While the user is playing a tune on the keyboard 101*a*, the host controller 104 periodically fetches the pieces of positional data information stored in the key position signals to see whether or not the user depresses or releases any one of the black/white keys 101*f*/101*g*. When the host controller 104 finds a depressed key or a released key, the host controller 104 specifies the note number assigned to the depressed/released key, and calculates the key velocity. The host controller 104 produces a music data code representative of the note number and the key velocity, and supplies it to the tone generator 102*c*. The tone generator 102*c* generates an audio signal from the music data code, and the sound system 102*c* generates an electronic tone instead of the acoustic piano tone.

When the user selects the ensemble mode, the playback system 102 cooperates with the key sensors 103*a* and the audio-visual system 300 with assistance of the local controller 200. The host controller 104 firstly instructs the silent system 107 to change the hammer stopper 107*a* to the blocking position. Music data codes are formatted in accordance with the MIDI standards, and, accordingly, are hereinbelow referred to as "MIDI music data codes". The MIDI music data codes are read out from the suitable information storage medium, and the disk driver 106 transfers the MIDI music data codes to the host controller 104.

The host controller 104 selectively actuates the solenoid-operated key actuators 102*b* in accordance with the MIDI music data codes representative of a part of a music score to be performed by a trainee. However, the solenoid-operated key actuators 102*b* do not project the plungers until the upper dead points. The solenoid-operated key actuators 102*b* stop the plunger before escaping the jacks 101*n* from the hammers 101*c* so as to guide the trainee along the part to be performed. The fingering on the keyboard 101*a* is monitored by the array of key sensors 103*a*. The key sensors 103*a* produces the key position signals representative of the current key positions, and supplies the key position signals to the host controller 104. When the host controller 104 finds a depressed black/white key 101*f*/101*g*, the host controller 104 produces the music data code for the depressed key, and supplies the music data code to the tone generator 102*c*. The sound system 102*c* generates the electronic sound instead of the acoustic piano tone.

While the trainee is fingering on the keyboard 101*a*, the host controller 104 checks the key position signals to see whether or not the trainee passes the black/white key 101*f*/101*g* at marked points in the given part, and transfers selected MIDI music data codes through the MIDI interface port 110 to the local controller 200. If the fingering is delayed, the host controller 104 stops the guide for a trainee and the data transfer to the local controller 200, and waits for the black/white key at the marked point. When the trainee depresses the black/white key 101*f*/101*g* at the marked point, the host controller 104 restarts the guide for a trainee and the data transfer to the local controller 200. With the MIDI music data codes, the local controller 200 restarts the actuation of the audio-visual system. The solenoid-operated key actuators 102*b* and the audio-visual system 200 are synchronized with the fingering on the keyboard 101*a*. Thus, the host controller 104 and the local controller 200 as a whole constitute an electronic synchronizer according to the present invention.

Figure 4:
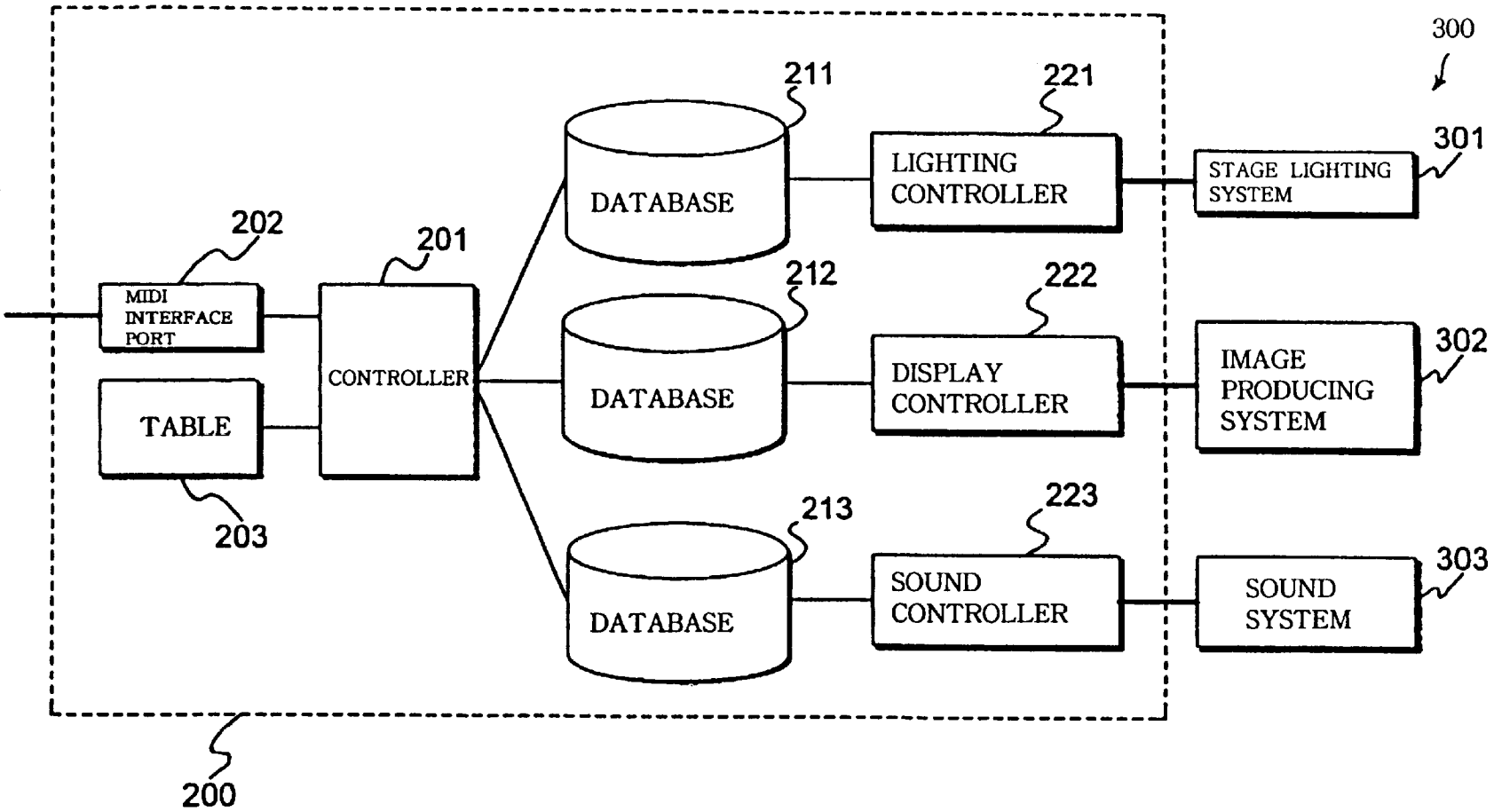
FIG. 4 is a black diagram showing the arrangement of components incorporated in the local controller.

Turning to FIG. 4 of the drawings, the local controller 200 comprises a controller 201, a MIDI interface port 202, a table 203, a database 211 for lighting, another data base 212 for image production, yet another database 213 for sound and controllers 221/222/223. The controller 201 includes a central processing unit, a program memory, a working memory and an interface, and the central processing unit is communicable through the interface to the MIDI interface port 202, the tables 203 and the databases 211/212/213. The MIDI interface port 202 is connected through the MIDI cable 111 to the MIDI interface port 110 of the keyboard musical instrument so that the controller 201 is communicable with the host controller 104.

The table 203 stores a relation between the note numbers and file names. The note number is stored in the MIDI music data code, and the file names are indicative of files stored in the databases 211/212/213. Pieces of control data information are stored in the file for controlling the audio-visual system 300. A part of the relation will be described hereinlater in detail.

The database 211 is assigned to the stage lighting system 301, and has plural files. As described hereinbefore, a piece of control data information is stored in each of the files. The piece of control data information is representative of an instruction to be given to the lighting controller 221 and data relating the instruction. The lighting controller 221 controls the stage lighting system 301 in compliance with the instruction.

The database 212 is assigned to the image producing system 302, and also has plural files. A piece of control data information is stored in each of the files. The piece of control data information is representative of an instruction to be given to the display controller 222 and data relating the instruction. The display controller 222 controls the image producing system 302 in compliance with the instruction, and produces a static picture or a moving picture from the relating data.

The database 213 is assigned to the sound system 303, and also has plural files. A piece of control data information is stored in each of the files. The piece of control data information is representative of an instruction to be given to the sound controller 222 and data relating the instruction. The display controller 222 controls the sound system 302 in compliance with the instruction, and generates sound or tones from the relating data.

Multi-track Music Data Codes and Data Organization

Figure 5:
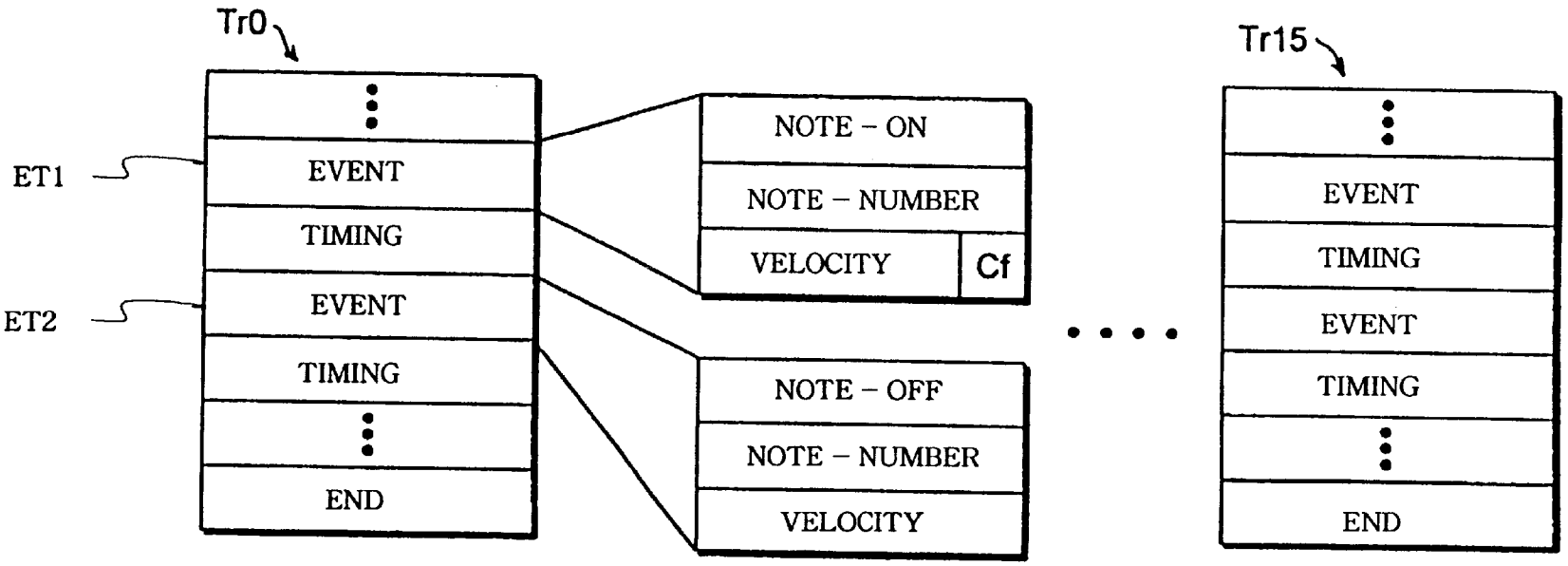
FIG. 5 is a view showing the contents of a series of music data codes formatted in the MIDI standards.

FIG. 5 shows the MIDI music data codes read out from an information storage medium. Pieces of music data information stored in the MIDI music data codes are broken down into event data, timing data and control data. A kind of event such as a note-on event or a note-off even, the note number and a velocity are memorized in a piece of event data, and a time interval between an event and the previous event is stored in a piece of timing data. Each of the note-on time and the note-off time is given as a lapse of time from the previous key event. The key velocity is corresponding to the velocity. The control data "END" is representative of a message that the performance is to be terminated. The user can assign sixteen tracks Tr0 to Tr15 to difference instruments according to the MIDI standards. For this reason, pieces of event data, associated pieces of timing data and the control data "END" form a piece of sequence data for one of the tracks Tr0 to Trl5.

The piece of sequence data Tr0 contains pieces of event data ET1/ET2 and pieces of timing data associated with the pieces of event data ET1/ET2. The piece of event data ET1 has storage areas assigned to the note-on event, the note number and the velocity. According to the present invention, a cue flag Cf is storable in the storage area assigned to the velocity. The cue flag is indicative of the mark point at which the audio-visual system 300 is to be synchronized with the keyboard musical instrument 100.

The principal melody line in a tune is performed by a pianist on the keyboard musical instrument 100, and one of the tracks Tr0 is assigned to a piece of sequential data representative of the principal melody line. The cue flags Cf are stored in pieces of event data of the piece of sequential data at intervals. Another piece of sequential data is assigned to the audio-visual system 300, and is assigned to other track or tracks. The track Tr0 and the other track are hereinbelow referred to as "principal melody track" and "external control track", respectively. The host controller 104 checks the key position signals to see whether or not the pianist depresses the black/white key 101/101*g* represented by the note number marked with the cue flag Cf. The MIDI music data codes in the principal melody track Tr0 is made synchronous with the actually depressed black/white keys 101*f*/101*g,* and the MIDI music data codes in the external control track Tr2 is also synchronized. The audio-visual system 300 is automatically synchronized with the fingering on the keyboard 101*a*. Thus, more than two parts are synchronously controlled.

FIG. 6 shows the relation between the tracks Tr0 to Tr15 and the components of the ensemble system to be controlled. The relation shown in FIG. 6 is stored in a set of MIDI music data codes representative of a performance. For this reason, when the disk driver 106 transfers the set of MIDI music data codes to the working memory of the host controller 104, the relation is tabled in the working memory. In this instance, the tracks Tr0 and Tr1 are assigned to the MIDI data codes representative of the principal melody and the MIDI music data codes representative of another part such as an accompaniment assigned to the tone generator 102*c,* respectively, and the music data codes for the audio-visual system 300 are transferred through the track Tr2. Thus, the electronic synchronizer 104/200 controls the solenoid-operated key actuators 102*b,* the tone generator 102*c* and the audio-visual system 300 through more than two tracks selectively assigned to the components 10-2*b*/102*c*/300. In this instance, the tracks Tr0 and Tr2 are corresponding to the principal melody track and the external control track, respectively.

FIG. 7 shows a relation between the note numbers and the file names. The relation is stored in the table 203 of the local controller 200 as described hereinbefore. The note number is described in the MIDI music data code representative of a piece of event data for the note-on event. The MIDI music data codes transferred through the track Tr2 are used for controlling the audio-visual system 300. For this reason, the MIDI music data codes for the note-on events have the storage areas assigned to control data codes respectively designating pieces of control data information for the audio-visual system 300. The control data codes representative of the file names, respectively, and are corresponding to the note numbers, respectively. A hundred and twenty-eight note numbers are equivalent to a hundred twenty-eight control data codes "0" to "127", which are indicative of the file names "1001" to "3210" as shown in FIG. 7. The files "1001" to "3210" are broken down into three file groups, and the three file groups form the databases 211/212/213, respectively. Thus, the control data codes have the format identical with the music data codes of the MIDI standards. For this reason, the MIDI music data codes are shared between the keyboard musical instrument 100 and the audio-visual system.

The host controller 104 supplies the MIDI music data codes representative of the pieces of sequence data through the track Tr2 to the local controller 200, and the controller 201 searches the table 203 for the file name designated by the control data code. When the controller 201 finds a file name corresponding to the control data code, the controller accesses the file, and fetches the piece of control data information stored in the file.

Operation in Ensemble Mode

Figure 8:
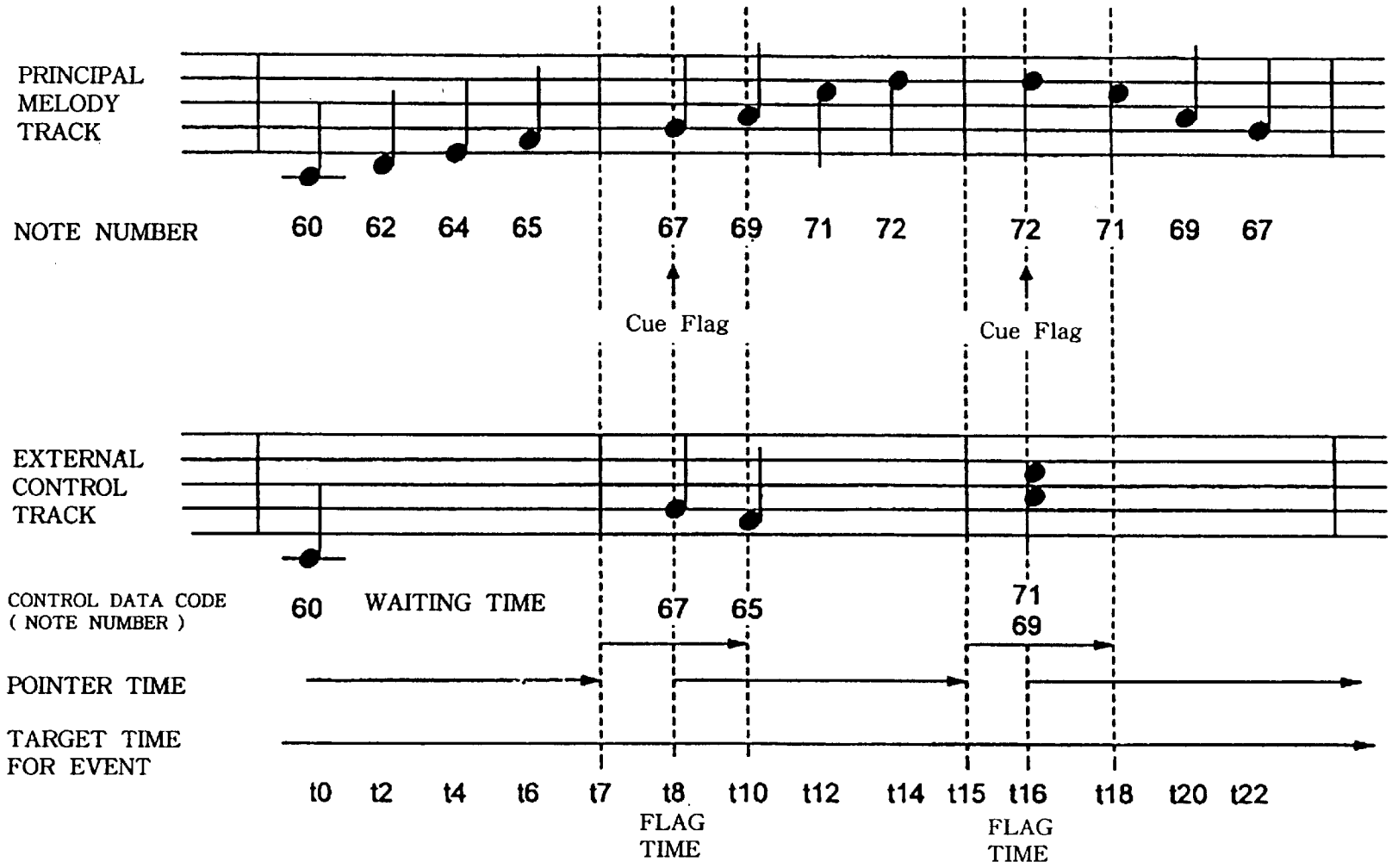
FIG. 8 is a view showing a music score for an ensemble mode.

A set of MIDI music data codes represents a score, a part of which is shown in FIG. 8. The set of MIDI music data codes is stored in the information storage medium. The set of MIDI music data codes is broken down into a piece of sequence data representative of a principal melody and another piece of sequence data representative of instructions to the audio-visual system 300. The MIDI music data codes for the principal melody are assigned the principal melody track, and the MIDI music data codes for the audio-visual system 300 are assigned the external control track.

A "target time for event " is equal to the accumulation of pieces of timing data until the associated piece of event data, and is representative of a time at which the associated event such as the note-on event or note-off event is to take place. If the controller achieves the resolution twice as long as a quaver note, the note-on events for the first to fifth quarter notes occur at t0, t2, t4, t6 and t8. The cue flags Cf are added to the note numbers "67" and "72" indicated by the fifth quarter note and the ninth quarter note, respectively. The ninth quarter note has the note-on event at t16. The target time for event is shared between all the tracks Tr0 to Tr15. For this reason, the host controller 104 synchronizes data processing on the MIDI music data codes in the principal melody track Tr0 with data processing on the MIDI music data codes in the external control track Tr2. The cue note Cf is assumed to be stored in a MIDI music data code for a certain note. The note-on event for the certain note occurs at a "flag time". In other words, the flag time is equivalent to the target time for event at which the certain note is to be synchronized with an instruction for the audio-visual system 300. A "flag event" is a detection of the depressed key 101*f*/101*g* corresponding to the note marked with the cue flag Cf.

Read-out timers are provided for the tracks, respectively, and each of the read-out timers stores a read-out time. The read-out time is equivalent to a time period until read-out of a piece of event data, and is stepwise decremented by the host controller 104. Namely, when the read-out time reaches zero, the associated piece of event data is read out for the data processing. The read-out time is earlier than the target time by a predetermined time interval. For this reason, the associated piece of event data is read out before the target time.

A "pointer time" is a time stored in the internal clock. The internal clock is incremented at regular time intervals by a clock signal representative of a tempo. According to the present invention, selected notes in the principal melody are accompanied with the cue flags Cf for synchronizing the principal melody with the fingering on the keyboard 101*a*. The synchronization is achieved by temporarily stopping the internal clock. For this reason, it is not necessary to increment the pointer time at regular time intervals.

Term "waiting time" means a lapse of time after entry into waiting status. When the read-out timer for the principal melody track Tr0 reaches zero, the associated piece of event data containing the cue flag Cf enters the waiting status, and the waiting status continues for a predetermined time period. As will be described hereinlater, the piece of event data containing the cue flag Cf is read out before the target time of the event by a predetermined time period. In this instance, the predetermined time period is equivalent to the time period represented by a thirty-second note. The piece of event data with the cue flag Cf exits from the waiting status when the trainee depresses a black/white key within the predetermined time period or the predetermined time period is expired without depressing the black/white key. The pointer time is not incremented in the waiting status. When the flag event takes place, the internal clock is set for the flag time, and restarts to increment the pointer time. On the other hand, when the predetermined time period is expired without flag event, the internal clock is set for the event time of the nonexecuted event data. Thus, the internal clock is periodically regulated at the marked points in the principal melody, and the data transfer to the local controller 200 is also periodically regulated, because the event time is shared between all the tracks.

The host controller 104 assigns particular storage areas of the working memory to a depressed key buffer, an event buffer and a cue flag buffer. FIGS. 9A to 9C show the depressed key buffer, the event buffer and the cue flag buffer, respectively.

The depressed key buffer stores the note number assigned to the latest depressed key 101*f*/101*g*. The host controller 104 has a table between black/white keys 101*f*/101*g* and the note numbers assigned thereto. When the host controller 104 finds the user to depress a black/white key 101*f*/101*g* on the basis of the variation of current key position, the host controller 104 checks the table to see what note number is assigned to the depressed key 101*f*/101*g*. The host controller 104 identifies the depressed key 101*f*/101*g*, and writes the note number of the depressed key into the depressed key buffer. In other words, the host controller 104 maintains the note number of the black/white key 101*f*/101*g* just depressed by the user in the depressed key buffer. The depressed key buffer shown in FIG. 9A teaches that the user has just depressed the black/white key assigned the note number "65".

The event buffer stores pieces of event data to be processed. The pieces of event data to be processed are grouped by the track, the kind of event, the note number and the target time are stored together with the track number. The event buffer shown in FIG. 9B indicates that a MIDI music data code for the note-on event of the tone identified with the note number 67 is to be processed at the target time t8 for actuating the associated solenoid-operated key actuator 102*b* and that the MIDI music data code for the note-on event at the note number 67 is to be transferred at target time t8 to the local controller 200.

The cue flag buffer teaches the target time at which the MIDI music data code with the cue flag Cf is to be processed and a lapse of time from the registration thereinto.

Figure 10:
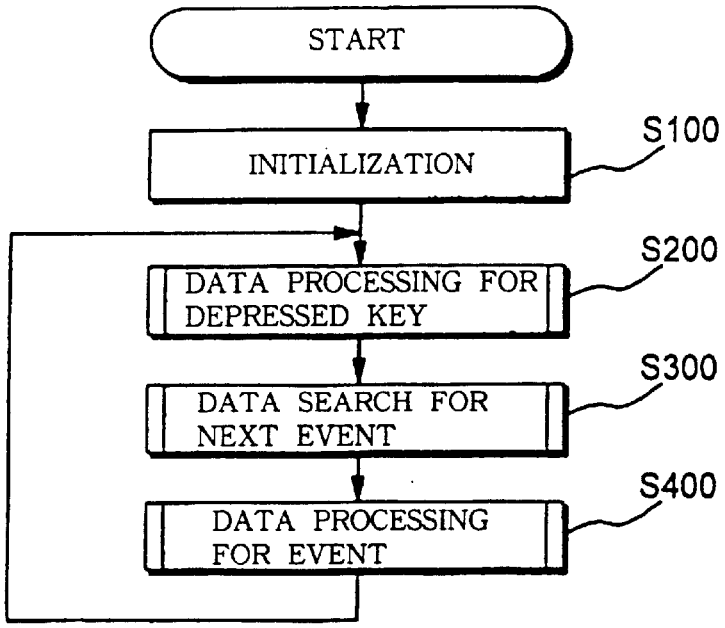
FIG. 10 is a flowchart showing a main routine program executed by the host controller.

The host controller 104 processes the MIDI music data codes in the ensemble mode as follows. FIG. 10 illustrates a main routine program for the host controller 104.

When the host controller is energized, the host controller 104 starts the main routine program. The host controller 104 firstly initializes the buffers and the internal clock as by step S100. After the initialization, the host controller 104 waits for user's instruction. When the user instructs the ensemble mode through the display unit 105 to the host controller 104, the host controller 104 reiterates the loop consisting of sub-routine programs S200, S300 and S400 until termination of the ensemble. The host controller 104 carries out a data processing for a depressed key through the sub-routine program S200, and a data search for next event and a data processing for the event are carried out through the sub-routine programs S300 and S400, respectively. The host controller 104 circulates through the loop within unit time. The unit time is long enough to permit all the events concurrently scheduled to occur.

Figure 11:
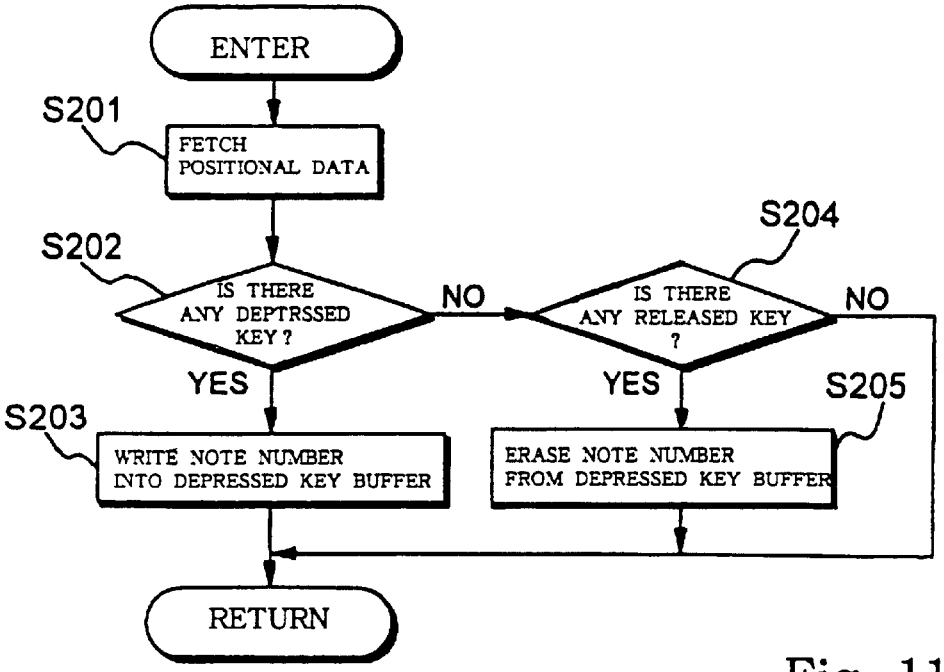
FIG. 11 is a flowchart showing a sub-routine program forming a part of the main routine program.

The host controller 104 achieves tasks shown in FIG. 11 through the sub-routine program S200. When the main routine program branches into the sub-routine program S200, the host controller 104 fetches the pieces of positional data information represented by the key position signals from the interface assigned to the key sensors 103*a* as by step S201, and stores the pieces of positional data information in the working memory. The host controller 104 checks the pieces of positional data information to see whether or not any one of the black/white keys 101*f*/101*g* is depressed by the trainee as by step S202. When the host controller 104 finds a black/white key 101*f*/101 *g* to be depressed, the answer at step S202 is given affirmative, and the host controller 104 writes the note number assigned to the depressed key into the depressed key buffer as by step S203. On the other hand, if the host controller 104 does not find any depressed key, the host controller 104 proceeds to step S204, and checks the pieces of positional data information to see whether or not the trainee released the depressed key. When the host controller 104 finds that the trainee releases the depressed key, the host controller 104 erases the note number from the depressed key buffer as by step S205. Upon completion of the data processing at step S203 or S205, the host controller 104 returns to the main routine program.

Figure 12:
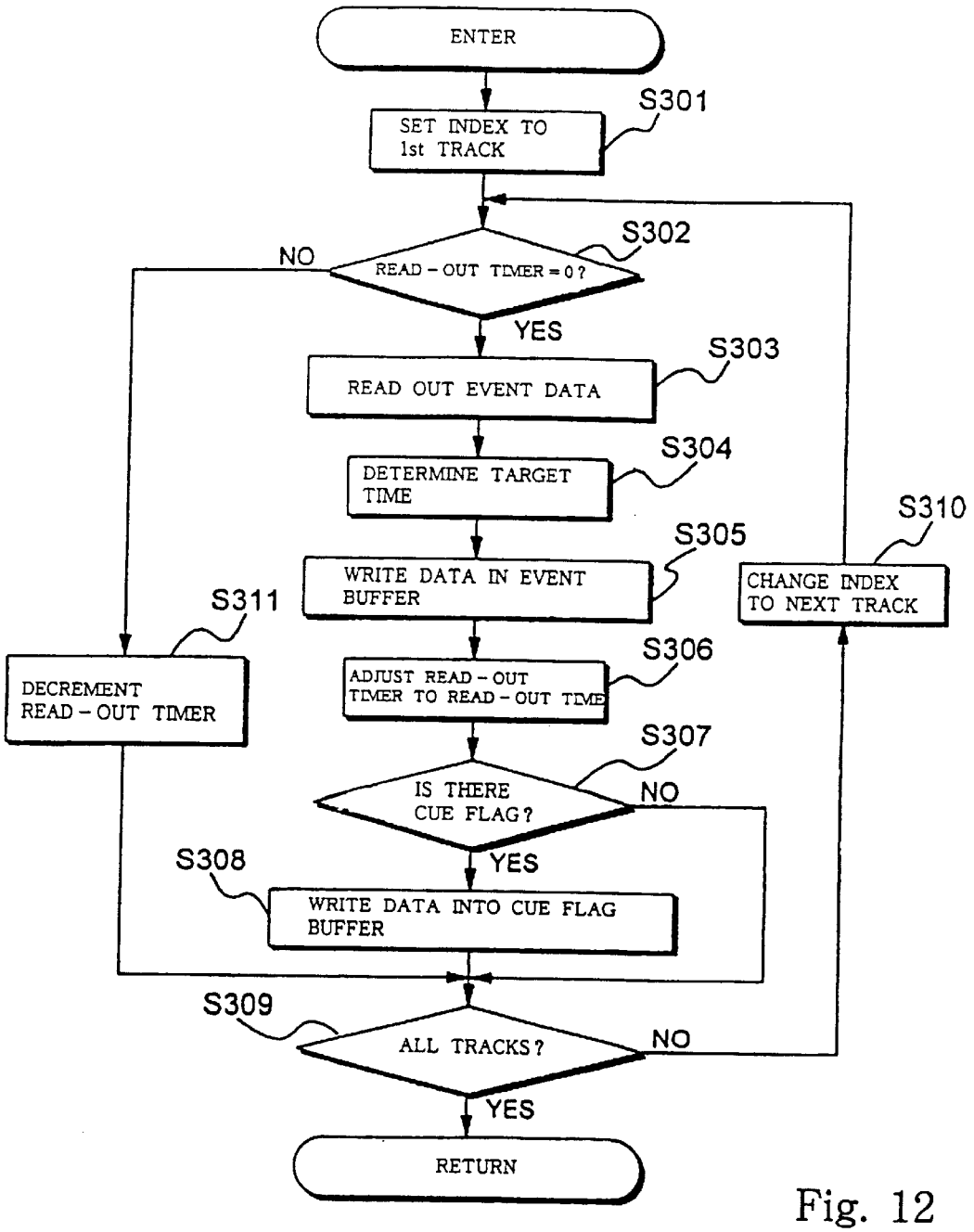
FIG. 12 is a flowchart showing a sub-routine program forming another part of the main routine program.

In the sub-routine program S300, the host controller 104 achieves tasks shown in FIG. 12. The host controller 104 writes the pieces of event data to be processed and the target time in the event buffer through the sub-routine program. First, the host controller 104 sets an index to the first track Tr0 as by step S301. The host controller 104 checks the read-out timer associated with the selected track to see whether or not the read-out time reaches zero as by step S302. Any read-out time has not been stored in the read-out timer immediately after the initiation of the ensemble, and the answer at step S302 is given affirmative. If the read-out timer was set, the read-out time has been decremented in each execution of the sub-routine program S300. Finally, the read-out timer indicates that the read-out time is zero, and the answer at step S302 is given affirmative. The read-out time is earlier than the target time by a predetermined time. Then, the host controller 104 proceeds to step S303, and reads out the first piece of event data. Subsequently, the host controller 104 determines the target time on the basis of the associated piece of timing data as by step S304, and writes the kind of event, the note number and the target time in the row of the event buffer assigned to the given track as by step S305. The host controller 104 determines the read-out time earlier than the target time by the predetermined time period, and adjusts the read-out timer to the read-out time as by step S306. The host controller 104 checks the piece of event data to see whether or not the cue flag Cf is stored in the piece of event data as by step S307. If the cue flag Cf is found, the answer at step S307 is given affirmative, and the host controller 104 writes the note number, the flag time and the waiting time into the cue flag buffer (see FIG. 9C) as by step S308. When the host controller 104 writes them into the cur flag buffer, the waiting time is zero. The piece of event data enters into the waiting status. The host controller 104 proceeds to step S309. When the piece of event data does not contain the cue flag Cf, the answer at step S307 is given negative, and the host controller 104 checks the index to see whether or not pieces of event data are written into the event buffer for all the tracks as by step S309. If the answer at step S309 is given negative, the host controller 104 increments the index as by step S310, and returns to step S302.

If the host controller 104 adjusted the read-out timer to the read-out time in the previous execution, the answer at step S302 is given negative, and the host controller 104 proceeds to step S311. The host controller 104 decrements the read-out time at step S311, and proceeds to step S309 without execution of steps S303 to S308. The host controller 104 reiterates the loop consisting of steps 302 to 310 until the index indicates the last track. Upon completion of the data search for the pieces of event data, the host controller 104 returns to the main routine program.

Figure 13:
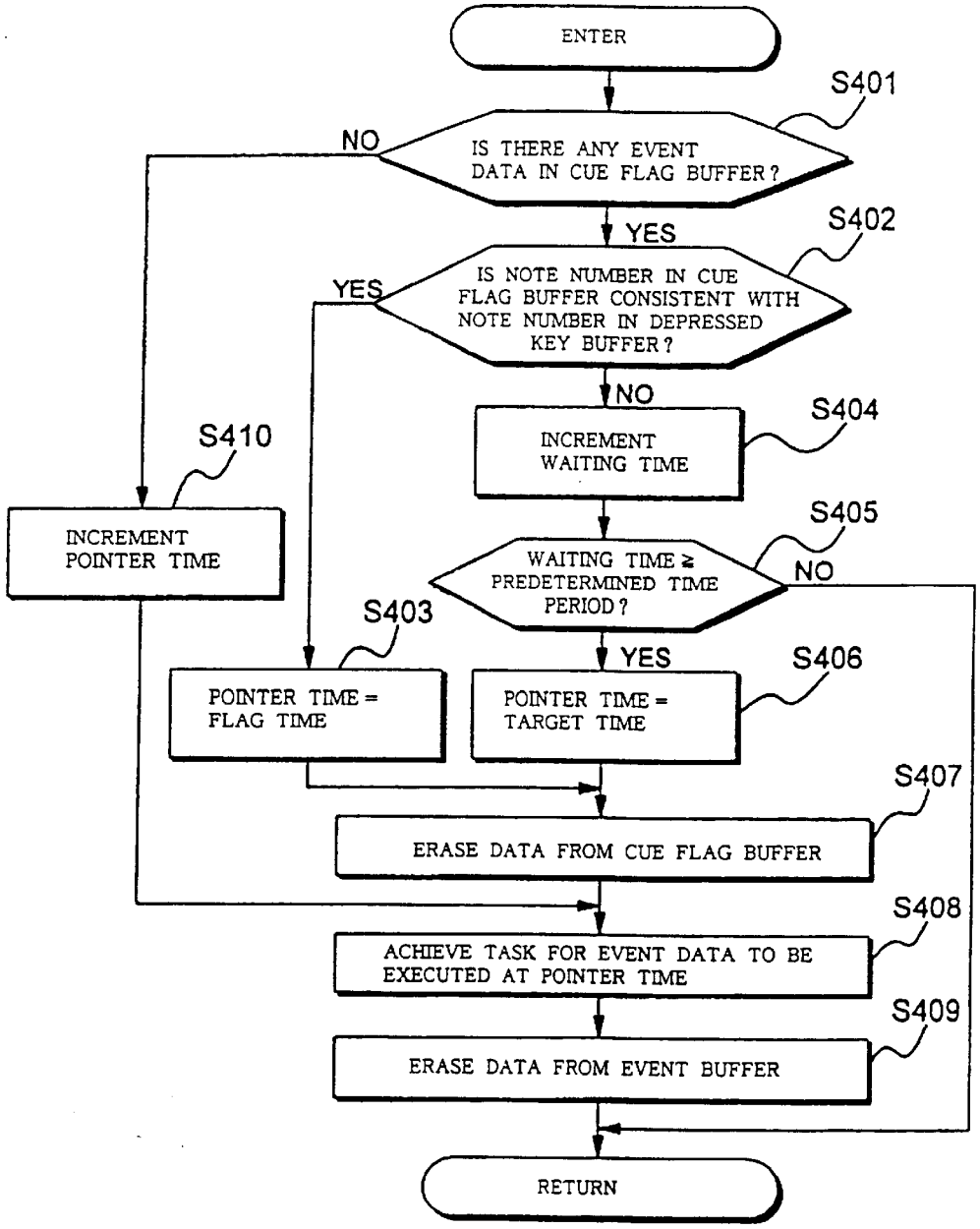
FIG. 13 is a flowchart showing a sub-routine program forming yet another part of the main routine program.

The sub-routine program S400 is carried out for tasks shown in FIG. 13. The host controller 104 synchronizes the audio-visual system 300 with the fingering on the keyboard 101*a* through the sub-routine program S400. When the main routine program branches to the sub-routine program S400, the host controller 104 checks the cue flag buffer to see whether or not any piece of event data has been already written therein as by step S401. If the host controller 104 has not written any piece of event data in the cue flag buffer, the answer at step S402 is given negative, and the host controller 104 proceeds to step S410. The host controller 104 increments the pointer time at step S410.

On the other hand, when the host controller 104 finds a piece of event data in the cue flag buffer, the answer at step S401 is given affirmative, and the host controller 104 proceeds to step S402. The host controller 104 compares the note number stored in the cue flag buffer with the note number stored in the depressed key buffer to see whether or not they are consistent with each other at step S402. As described hereinbefore, when the piece of event data has written into the cue flag buffer, the piece of event data entered the waiting status.

On the other hand, when a black/white key was depressed, the note number assigned to the depressed key was written into the depressed key buffer. Therefore, if the note number in the cue flag buffer is consistent with the note number in the depressed key buffer, the trainee timely depresses the black/white key at the marked point in the principal melody within the predetermined time period. Then, the piece of event data exits from the waiting status, and the host controller 104 adjusts the pointer time to the flag time as by step S403.

On the other hand, if the trainee have not depressed the black/white key 1011*f*/101*g* at the marked point, yet, the note number stored in the depressed key buffer is different from the note number stored in the cue flag buffer, and the answer at step S402 is given negative. Then, the host controller 104 increments the waiting time stored in the cue flag buffer.

Subsequently, the host controller 104 checks the cue flag buffer to see whether or not the waiting time is equal to or greater than the predetermined time period as by step S405. Even if the trainee have not depressed the black/white key 101*f*/101*g* at the marked point in the principal melody, the delay is admittable in so far as the waiting time is shorter than the predetermined time period. Then, the host controller 104 immediately returns to the main routine program.

On the other hand, if the predetermined time period has been expired, the answer at step S405 is given affirmative, and the host controller 104 assumes that the trainee skips the note at the marked point in the principal melody either intentionally or unintentionally. Then, the host controller 104 adjusts the pointer time to the target time for the missing key 101*f*/101*g* as by step S406.

Upon completion of the adjustment at step S403 or S406, the host controller 104 erases the note number and the flag time from the cur flag buffer, and the waiting time is reset to zero as by step S407. Subsequently, the host controller 104 checks the event buffer to see whether or not the pointer time is equal to any one of the target times stored in the event buffer. If the host controller 104 finds the target time or times equal to the pointer time, the host controller 104 achieves the task or tasks for the piece or pieces of event data as by step S408. In detail, if the piece of event data is found in the principal melody track, the host controller 104 determines the target key velocity Vr, and instructs the servo-controller 102*a* to drive the solenoid-operated key actuator 102*b*. If the piece of event data in the track Tr1 has the target time equal to the pointer time, the host, the host controller 104 transfers the music data code to the tone generator/sound system 102*c,* and the tone generator/sound system 102*c* generates the electronic tone for the accompaniment. If the piece of event data in the external control track Tr2 has the target time equal to the pointer time, the host controller 104 transfers the piece of event data through the MIDI cable 111 to the local controller 200. Thereafter, the host controller 104 erases the kind of event, the note number and the target time associated with the piece of event data executed at S408 from the event buffer as by step S409. After step S409,the host controller returns to the main routine program.

As described in the previous paragraph, the pieces of event data in the external control track are sequentially transferred to the local controller 200 through the sub-routine program S400 (see step S408). With the piece of event data, the local controller 200 controls the audio-visual system 300 as follows.

Figure 14:
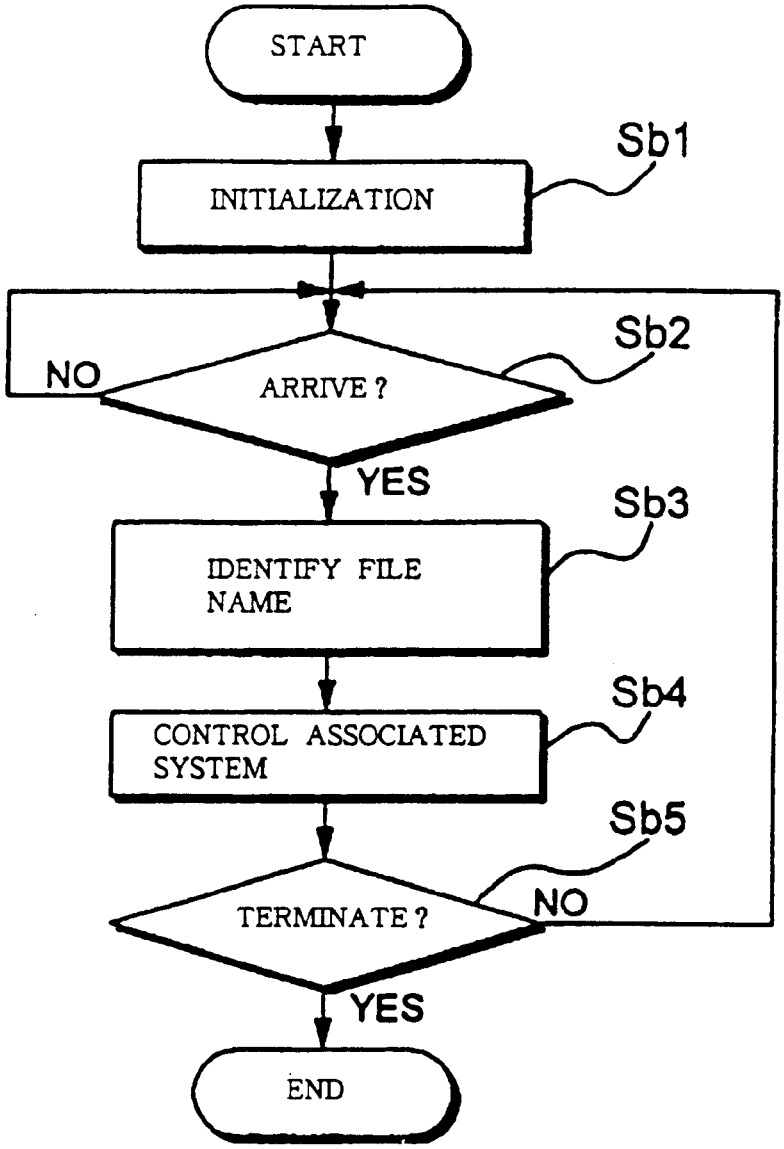
FIG. 14 is a flowchart showing a program sequence executed by a local controller.

FIG. 14 illustrates tasks for the local controller 200. When the local controller 200 is energized, the local controller 200 initializes the registers, butters and flags incorporated therein as by step Sb1. After the initialization, the controller 201 periodically checks the MIDI interface port 202 to see whether or not a MIDI music data code representative of a piece of event data arrives as by step Sb2. If any MIDI music data code does not arrive at the MIDI interface port 202, the answer at step Sb2 is given negative, and the controller 201 periodically checks the MIDI interface port 202 until arrival of the MIDI music data code.

When the host controller 104 transfers the MIDI music data code in the external control track to the local controller 200, the controller 201 finds the MIDI music data code at the MIDI interface port 202, and the answer at step Sb2 is changed to the positive answer. The controller 201 fetches the MIDI music data code. As described hereinbefore, the control data code is stored in the MIDI music data code, and is described in the same format as the bit string representative of the note number. The controller 201 compares the control data code with the note numbers in the table 203, and identifies the file name as being requested by the control data code as by step Sb3. The controller 201 notifies the file name and the database 211, 212 or 213 to the associated controller 221, 222 or 223, and the controller 221, 222 or 223 controls the associated system 301, 302 or 303 in accordance with the instructions stored in the file as by step Sb4. The controller 201 checks the internal register to see whether or not the control data "END" has been received as by step Sb5. If the answer is negative, the ensemble has not been terminated, and the controller 201 returns to step Sb2. Thus, the controller 201 reiterates the loop consisting of steps Sb2 to Sb5 until the control data "END" arrives at the MIDI interface port 202, and the three controller 221/222/223 independently controls the stage lighting system 301, the image producing system 302 and the sound system 303. When the controller 201 receives the control data "END", the answer at step Sb5 is changed to positive, and the controller 201 terminates the control sequence.

In the first embodiment, the audio-visual system 300 serves as a kind of instrument used for a purpose different from music, and the automatic player piano 100 is corresponding to another kind of instrument for producing a series of tones. The working memory stores the MIDI music data codes stored in the tracks Tr0 to Tr15, and the data storage area assigned to the MIDI music data codes serves as a first data source. The first piece of sequence data is corresponding to the MIDI music data codes in the principal melody track Tr0, and the cue flags Cf serve as pieces of synchronous data. On the other hand, the MIDI music data codes stored in the external control track Tr2 serve as a second piece of sequence data, and the pieces of event data are corresponding to the pieces of music data. The key sensors 103*a* supplies the key position signals representative of current key positions to the host controller 104, and is equivalent to a second data source. The table 203 serves as a converter, and the host controller 104 and the local controller 200 are corresponding to a first controller and a second controller, respectively.

As will be understood, the electronic synchronizer according to the present invention controls the keyboard musical instrument 100 and the audio-visual system 300 by using a set of multi-track music data codes such as, the MIDI musical data codes. Although the multi-track music data codes are formatted for musical instruments, the electronic synchronizer according to the present invention has the table 203 for converting the pieces of musical data information to the pieces of control data information for the audio-visual system, and the data format for the musical instrument is available for the audio-visual system.

The cue flag is stored in the particular music data codes, and the electronic synchronizer synchronizes the audio-visual system 100 and the keyboard musical instrument 300 with the fingering on the keyboard 101*a* at the points marked with the cue flags. Thus, the electronic synchronizer according to the present invention achieves the synchronization between more than two parts.

Second Embodiment

System Configuration

Figure 15:
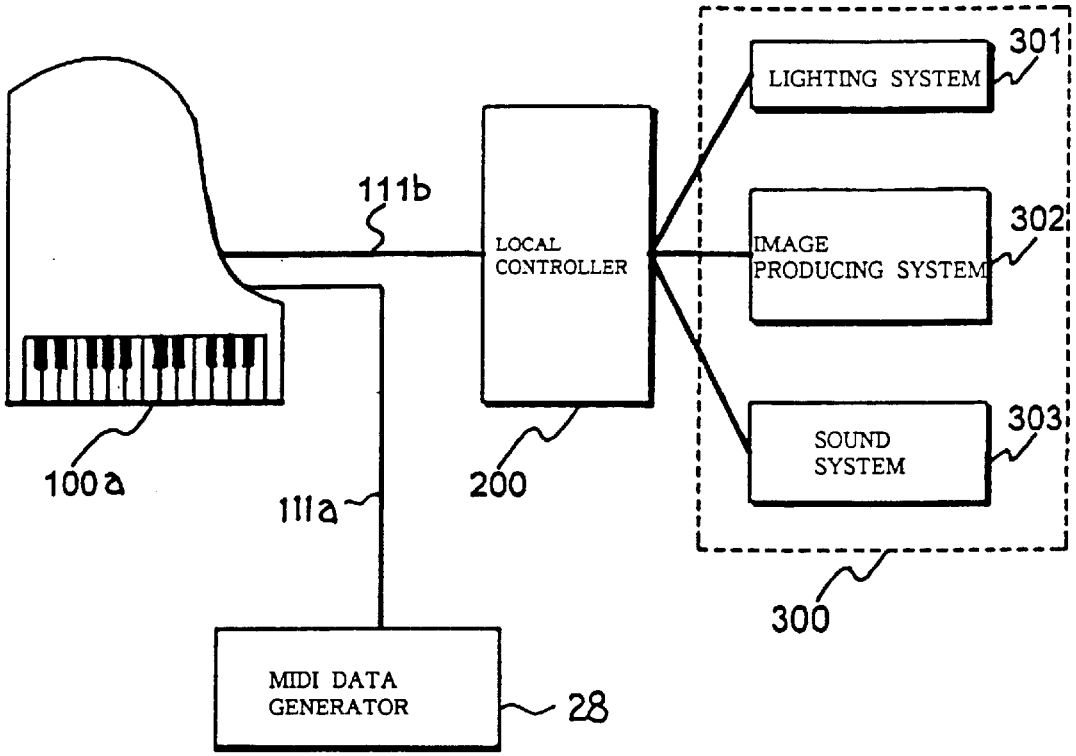
FIG. 15 is a block diagram showing another ensemble system according to the present invention.

Turning to FIG. 15 of the drawings, another ensemble system embodying the present invention comprises a keyboard musical instrument 100*a,* a local controller 200, an audio-visual system 300 and a MIDI data generator 28. The keyboard musical instrument 100*a* is connected through MIDI cables 111*a*/111*b* to the MIDI data generator 28 and the local controller 200, and the local controller 200 is connected to the audio-visual system 300. The MIDI data generator 28 produces MIDI music data codes, and supplies the MIDI music data codes through the MIDI cable 111*a* to the keyboard musical instrument 100. A set of MIDI data codes is representative of pieces of sequence data respectively assigned plural tracks. One of the pieces of sequence data represents fingering for a principal melody, and a pianist plays the principal melody on the keyboard musical instrument 100*a*.

Another piece of sequence data is representative of instructions for the audio-visual system. The keyboard musical instrument 100*a* transfers the piece of sequence data representative of the instructions for the audio-visual system through another MIDI cable 111*b* to the local controller 200. The local controller 200 interprets the pieces of sequence data, and controls the audio-visual system 300. A lighting system 301, an image producing system 302 and a sound system are incorporated in the audio-visual system. The local controller 200 instructs the lighting system to turn on and off a given timings, and requests the image producing system 302 to produce static images or a moving picture on a screen in synchronism with the principal melody. The sound system 303 produces sound effects under the control of the local controller 200.

Figure 16:
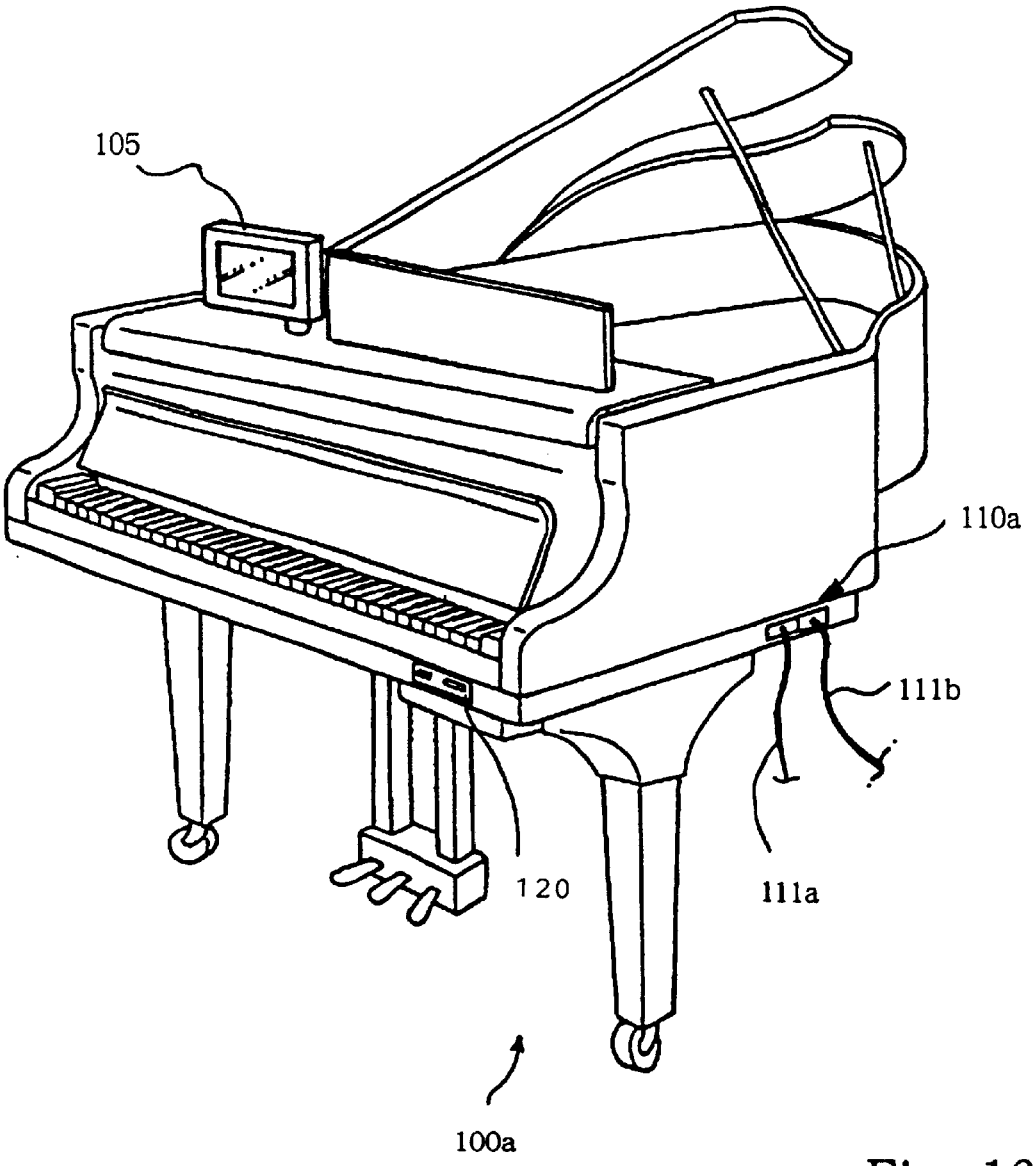
FIG. 16 is a perspective view showing an automatic player piano incorporated in the ensemble system.
Figure 17:
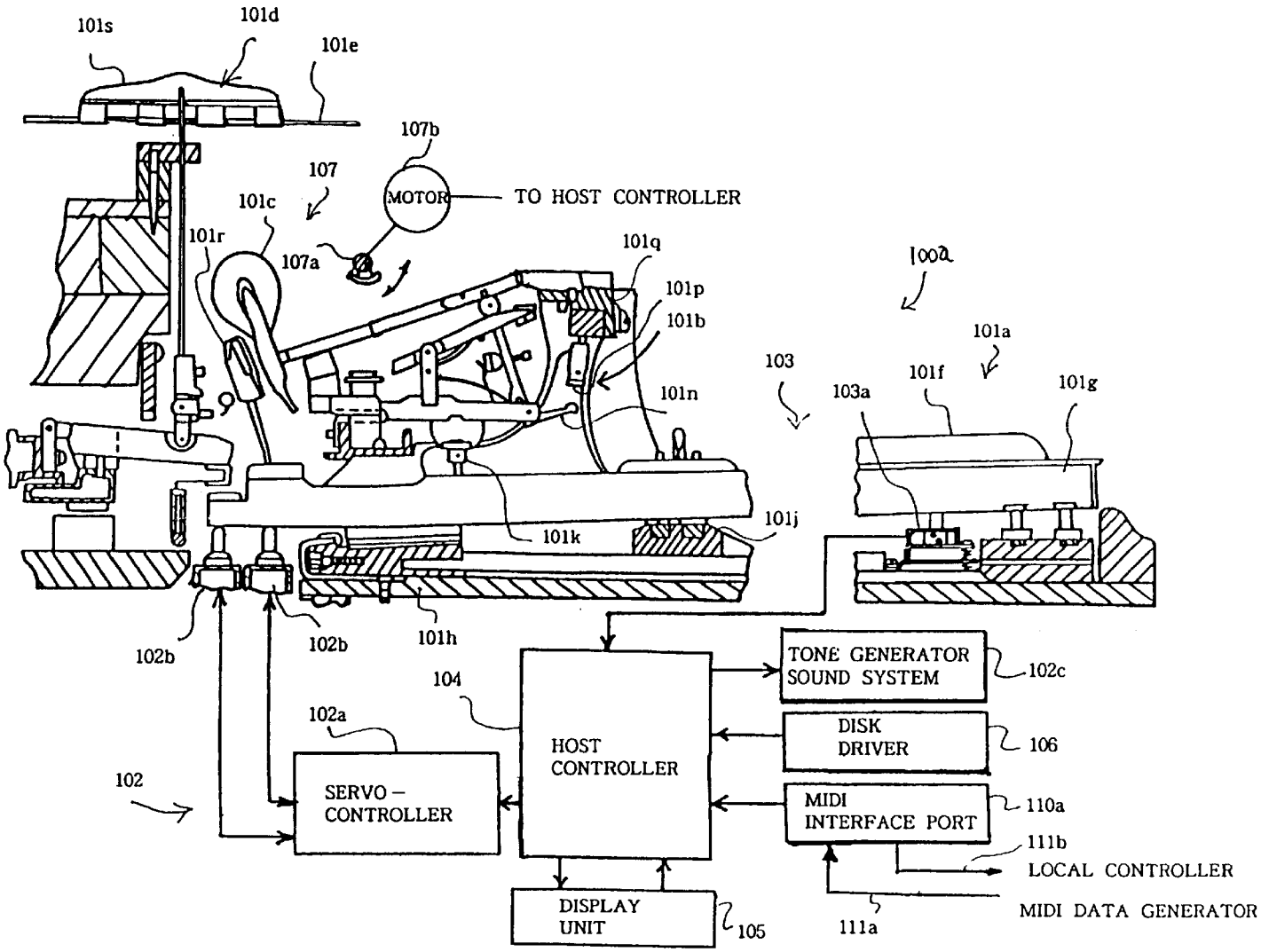
FIG. 17 is a cross sectional side view showing the automatic player piano.

FIGS. 16 and 17 illustrate the keyboard musical instrument 100*a*. The keyboard musical instrument 100*a* is implemented by an automatic player piano, and is similar in structure to the keyboard musical instrument except a MIDI interface port 110*a*. For this reason, other parts of the keyboard musical instrument are labeled with the references designating corresponding parts of the keyboard musical instrument 100 without detailed description.

The keyboard musical instrument 100*a* is operable in the recording mode, the playback mode, the acoustic sound mode, the silent mode and the ensemble mode. Although the ensemble mode is different from that of the first embodiment, the other modes of operation are described in conjunction with the keyboard musical instrument 100 of the first embodiment. For this reason, no further description is incorporated hereinbelow for avoiding repetition. The ensemble mode will be described hereinlater in detail.

The local controller 200 is similar to that of the first embodiment, and the circuit configuration is similar to that shown in FIG. 4. For this reason, description on the local controller 200 is omitted from the specification. In case where a component of the local controller 200 is to be required in the following description, FIG. 4 is referred to, again. The host controller 104 and the local controller 200 as a whole constitute an electronic synchronizer according to the present invention. The relation between the note numbers and the file names is stored in the table 203, and is shown in FIG. 7.

The MIDI data generator 28 is implemented by any kind of musical instrument in so far as the musical instrument generates MIDI music data codes in response to player's fingering.

Figure 18:
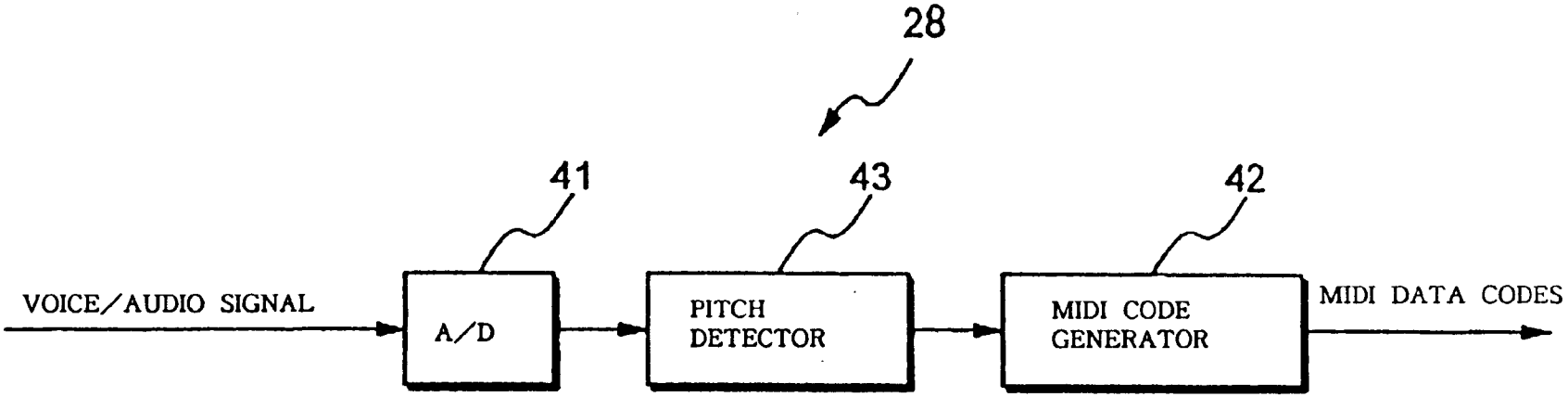
FIG. 18 is a block diagram showing the circuit configuration of a MIDI data generator.

Otherwise, the MIDI data generator 28 produces MIDI music data codes from a voice/audio signal in real time fashion as shown in FIG. 18. The MIDI data generator 28 comprises an analog-to-digital converter 41, a pitch detector 43 and a MIDI code generator 42. An audio system or a microphone is connected to the analog-to-digital converter 41, and the voice/audio signal is supplied to the analog-to-digital converter 41. The analog-to-digital converter 41 samples discrete parts of the voice/audio signal at predetermined intervals, and converts the discrete parts to a series of digital data codes. The digital data codes are successively supplied to the pitch detector 43, and the pitch detector 43 determines the pitch represented by each of the digital data codes. The pitch detector 43 notifies the pitch to the MIDI code generator 42. The MIDI code generator 42 determines the note number, and produces a MIDI music data code corresponding to each discrete part of the voice/audio signal. Thus, the MIDI data generator produces a series of MIDI music data codes from the voice/audio signal representing a human voice, a performance on an acoustic musical instrument or a recorded performance. When the microphone is put on the keyboard musical instrument, the voice/audio signal represents the acoustic piano tones actually performed on the keyboard 101*a*.

The electronic synchronizer synchronizes the keyboard musical instrument 100*a* and the audio-visual system 300 with the human voice or the performance on an acoustic musical instrument in the ensemble mode of operation.

Multi-track Music Data Codes and Data Organizational

According to the MIDI standard, sixteen tracks Tr0 to Tr15 are available for an ensemble. The MIDI music data codes have been described hereinbefore with reference to FIG. 5. The MIDI music data codes in the track Tr0 represents a principal melody sung by a trainee or performed by using an acoustic musical instrument. In this instance, the solenoid-operated key actuators 102*b* are selectively actuated with the piece of sequence data representative of the principal melody. The solenoid-operate key actuators 102*b* project plungers in the half stroke. For this reason, the black/white keys 101*f*/101*g* sink for indicating the note on the keyboard 101*a*. However, any acoustic piano tone is not generated. The tracks Tr1 and Tr2 are assigned to the tone generator/sound system 102*c* for the accompaniment and the audiovisual system 300 for audio-visual effects, respectively. Thus, the assignment of tracks is similar to that of the first embodiment (see FIG. 6).

Operation in Ensemble Mode

In the following description, definitions of "target time", "pointer time", "flag time" and "waiting time" are identical with those of the first embodiment (see FIG. 8). A term "receiving event" is newly used in the following description. The term "receiving event" means that the MIDI interface port 110*a* receives a MIDI music data code corresponding to the MIDI music data code marked with the cue flag Cf. Therefore, the piece of event data at the marked point exits from the waiting status when the receiving event takes place. The entry into the waiting status is identical with that of the first embodiment, and the waiting status continues a predetermined time period at the maximum. If the MIDI data code does not arrive at the MIDI interface port 110*a* within the predetermined time period, the piece of event data exits from the waiting status without any execution as similar to the first embodiment.

The host controller 104 defines three buffers in the working memory. The three buffers are called as "reception buffer", "event buffer" and "cue flag buffer" (see FIGS. 19A to 19C). The event buffer and the cue flag buffer are identical with those of the first embodiment, and the reception buffer is corresponding to the depressed key buffer. When the MIDI music data code arrives at the MIDI interface port 110*a,* the host controller 104 reads the note number, and writes the note number in the reception buffer. Thus, the reception buffer maintains the note number of a tone just produced by the singer or the acoustic musical instrument.

Figure 20:
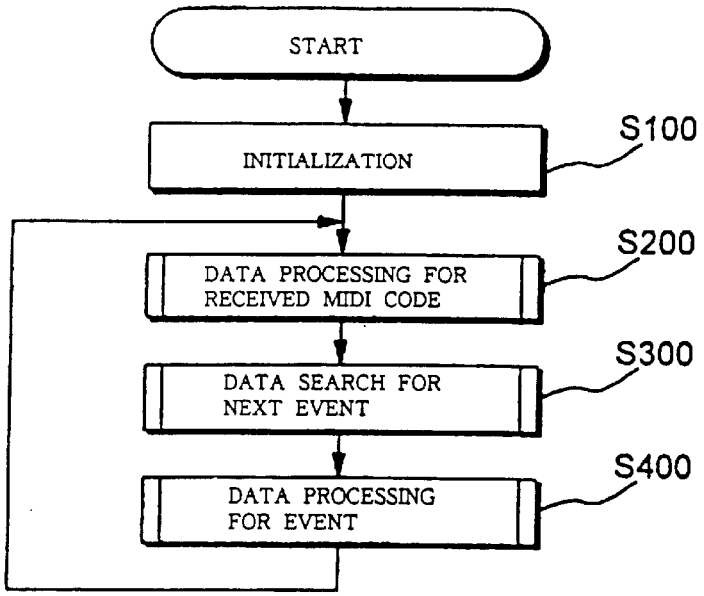
FIG. 20 is a flowchart showing a main routine program executed by the host controller.

When the ensemble system is powered, the host controller 104 initializes the working memory, internal registers, buffer and flag as by step S100 (see FIG. 20). Upon completion of the initialization, the host controller 104 waits for the instruction given through the display unit 105. When the user instructs the ensemble mode to the host controller 104, the host controller 104 reiterates the loop consisting of sub-routine programs S200, S300 and S400 until termination of the ensemble. The host controller 104 carries out a data processing for a MIDI music data code received from the MIDI data generator 28 through the sub-routine program S200, and a data search for next event and a data processing for the event are carried out through the sub-routine programs S300 and S400, respectively. The host controller 104 circulates through the loop within unit time. The unit time is long enough to permit all the events concurrently scheduled to occur.

Figure 21:
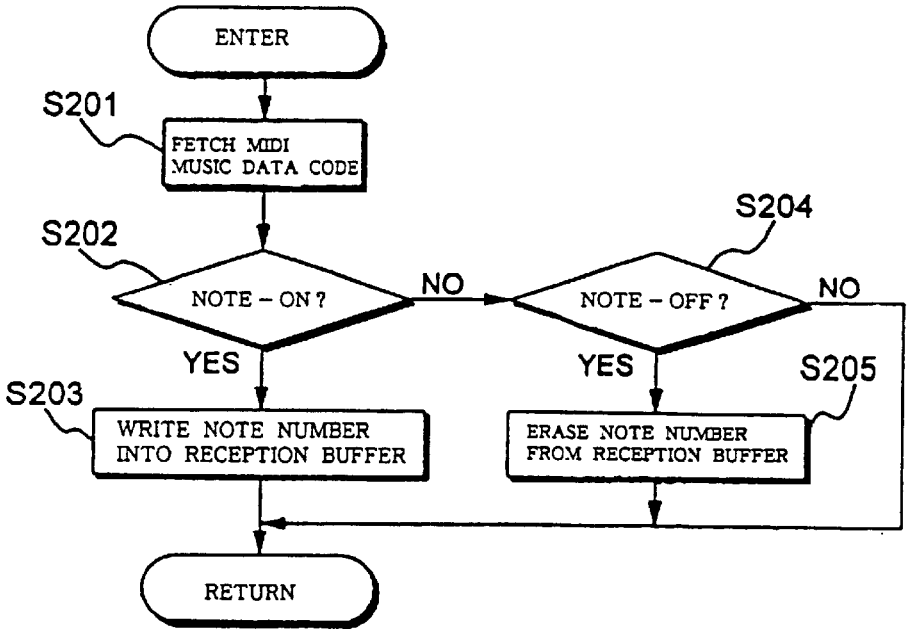
FIG. 21 is a flowchart showing a sub-routine program forming a part of the main routine program.

The host controller 104 achieves tasks shown in FIG. 21 through the sub-routine program S200. When the main routine program branches into the sub-routine program S200, the host controller 104 fetches the MIDI music data code from the MIDI interface port 110*a* assigned to the MIDI data generator as by step S201. The host controller 104 checks the MIDI music data code to see whether or not the note-on event is stored in the storage area as by step S202. When the host controller 104 finds the note-on event, the answer at step S202 is given affirmative, and the host controller 104 writes the note number into the reception buffer as by step S203. On the other hand, if the host controller 104 does not find the note-on event, the host controller 104 proceeds to step S204, and checks the MIDI data code to see whether or not the note-off event is stored in the storage area. When the host controller 104 finds the note-off event, the host controller 104 erases the note number from the reception buffer as by step S205. Upon completion of the data processing at step S203 or S205, the host controller 104 returns to the main routine program. In case where the negative answer is given at both steps S202 and S204, the MIDI music data represents another kind of data such as the control data, and the host controller 104 ignores the MIDI music data code.

Figure 22:
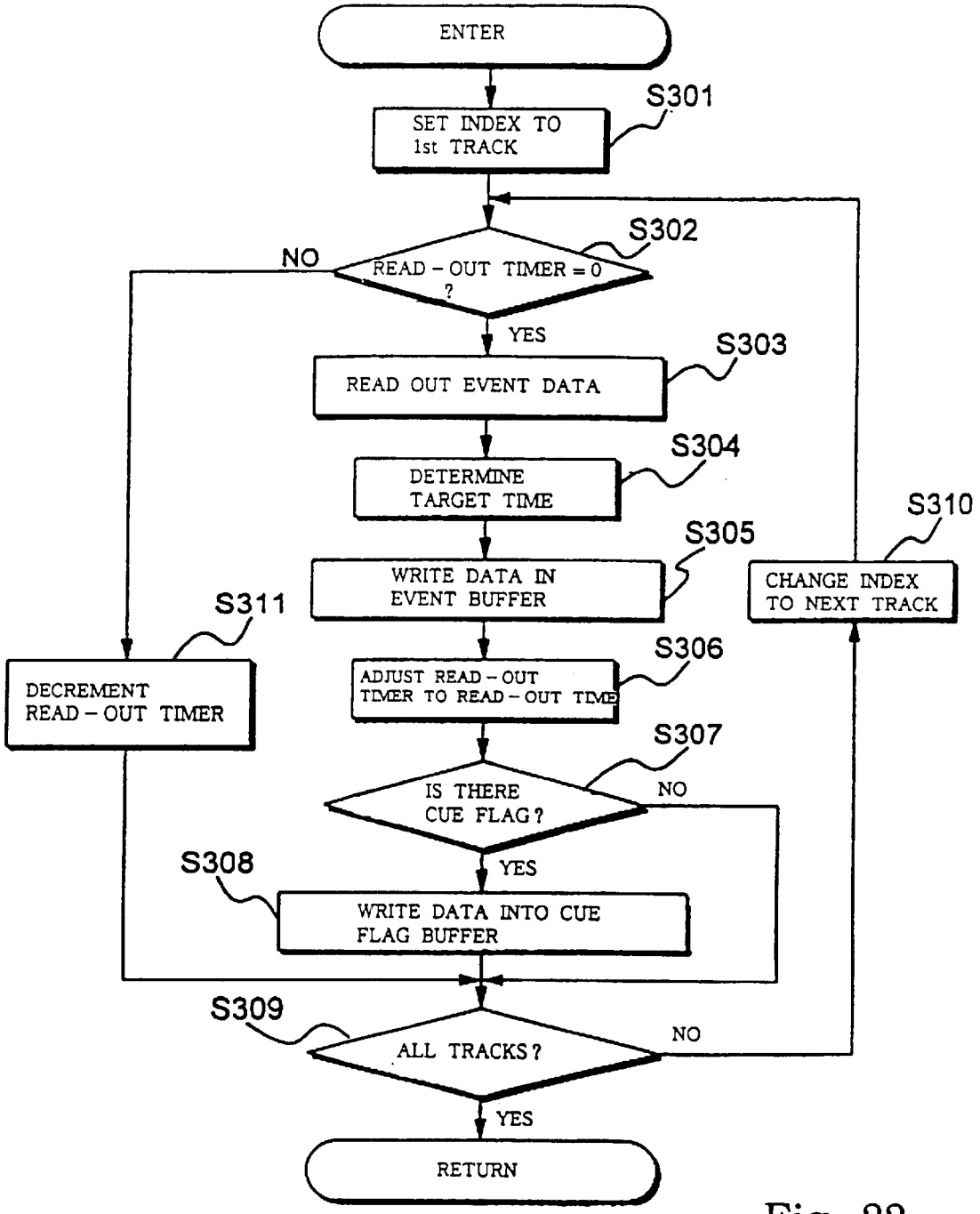
FIG. 22 is a flowchart showing a sub-routine program forming another part of the main routine program.

In the sub-routine program S300, the host controller 104 achieves tasks shown in FIG. 22. The host controller 104 writes the pieces of event data to be processed and the target time in the event buffer through the sub-routine program. First, the host controller 104 sets an index to the first track Tr0 as by step S301. The host controller 104 checks the read-out timer associated with the selected track to see whether or not the read-out time reaches zero as by step S302. Any read-out time has not been stored in the read-out timer immediately after the initiation of the ensemble, and the read-out time is zero. If the read-out timer was set, the read-out time has been decremented in each execution of the sub-routine program S300. Finally, the read-out time reaches zero. In either case, the answer at step S302 is given affirmative. The readout time is earlier than the target time by a predetermined time. With the positive answer, the host controller 104 proceeds to step S303, and reads out the first/next piece of event data. Subsequently, the host controller 104 determines the target time on the basis of the associated piece of timing data as by step S304, and writes the kind of event, the note number and the target time in the row of the event buffer (see FIG. 19B) assigned to the given track as by step S305. The host controller 104 determines the read-out time, which is earlier than the target time by the predetermined time period, and adjusts the read-out timer to the read-out time as by step S306. The host controller 104 checks the piece of event data to see whether or not the cue flag Cf is stored in the piece of event data as by step S307. If the cue flag Cf is found, the answer at step S307 is given affirmative, and the host controller 104 writes the note number, the flag time and the waiting time into the cue flag buffer (see FIG. 19C) as by step S308. The flag time is equal to the target time calculated at step S304. When the host controller 104 writes them into the cur flag buffer, the waiting time is zero. The piece of event data enters into the waiting status. The host controller 104 proceeds to step S309. When the piece of event data does not contain the cue flag Cf, the answer at step S307 is given negative, and the host controller 104 checks the index to see whether or not pieces of event data are written into the event buffer for all the tracks as by step S309. If the answer at step S309 is given negative, the host controller 104 increments the index as by step S310, and returns to step S302.

If the host controller 104 adjusted the read-out timer to the read-out time in the previous execution, the answer at step S302 is given negative, and the host controller 104 proceeds to step S311. The host controller 104 decrements the read-out time at step S311 by one, and proceeds to step S309 without execution of steps S303 to S308. The host controller 104 reiterates the loop consisting of steps 302 to 310 until the index indicates the last track. Upon completion of the data search for the pieces of event data, the host controller 104 returns to the main routine program.

Figure 23:
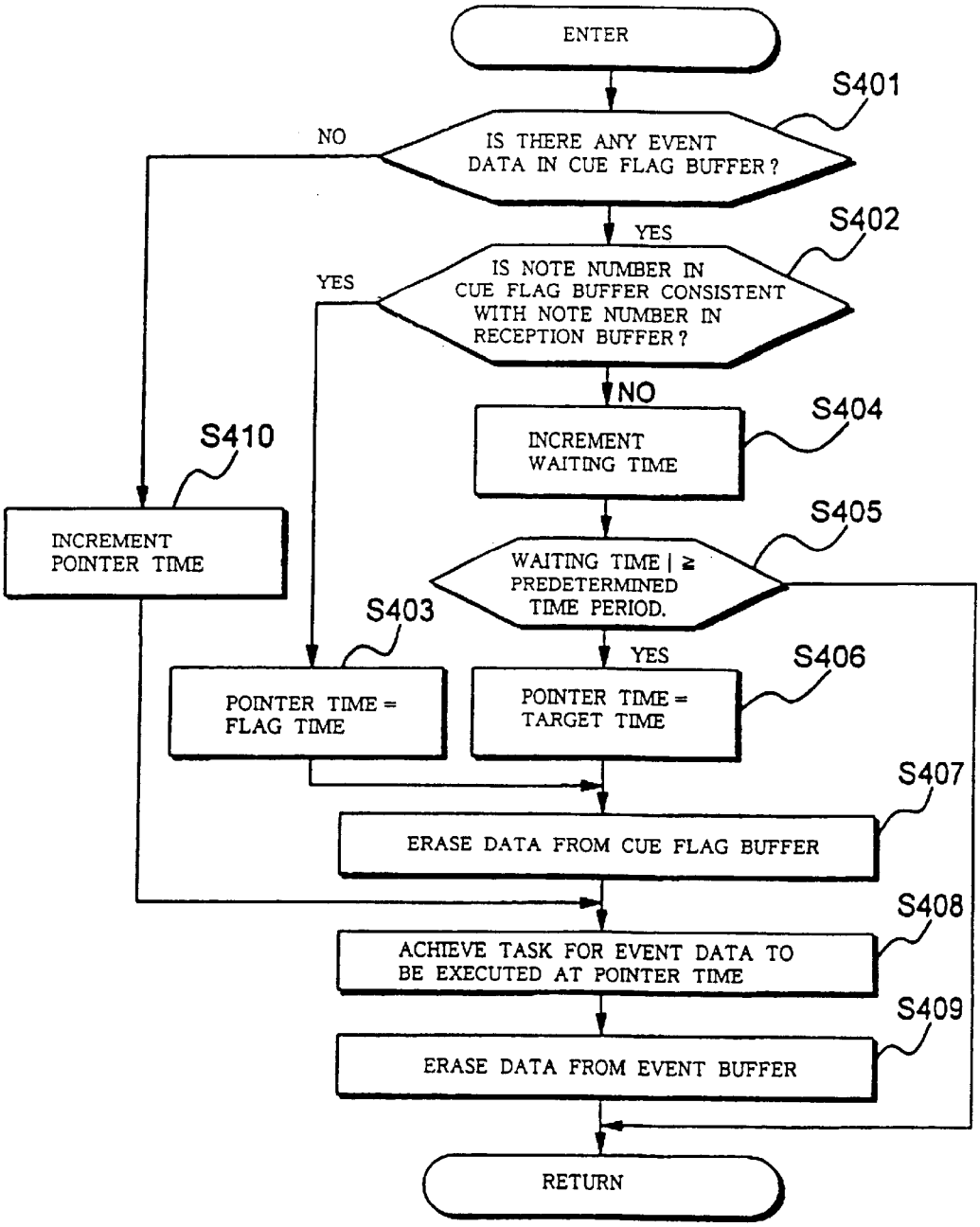
FIG. 23 is a flowchart showing a sub-routine program forming yet another part of the main routine program.

The sub-routine program S400 contains tasks shown in FIG. 23. The synchronization is achieved through the sub-routine program S400. When the main routine program branches to the sub-routine program S400, the host controller 104 checks the cue flag buffer to see whether or not any piece of event data has been already written therein as by step S401. If the host controller 104 has not written any piece of event data in the cue flag buffer, the answer at step S402 is given negative, and the host controller 104 proceeds to step S410. The host controller 104 increments the pointer time at step S410. Thus, the pointer time is stepwise incremented through the sub-routine program S400.

On the other hand, when the host controller 104 finds a piece of event data in the cue flag buffer, the answer at step S401 is given affirmative, and the host controller 104 proceeds to step S402. The host controller 104 compares the note number stored in the cue flag buffer with the note number stored in the reception buffer to see whether or not they are consistent with each other at step S402. As described hereinbefore, when the piece of event data has written into the cue flag buffer, the piece of event data entered the waiting status. On the other hand, when the MIDI music data code representative of the note-on event arrived at the MIDI interface port 110*a,* the note number stored in the MIDI music data code was written into the reception buffer. Therefore, if the note number in the cue flag buffer is consistent with the note number in the reception buffer, the user timely produces the tone at the marked point in the principal melody within the predetermined time period. Then, the piece of event data exits from the waiting status, and the host controller 104 adjusts the pointer time to the flag time as by step S403.

On the other hand, if the user have not generates the tone at the marked point in the principal melody, yet, the note number stored in the depressed key buffer is different from the note number stored in the cue flag buffer, and the answer at step S402 is given negative. Then, the host controller 104 increments the waiting time stored in the cue flag buffer.

Subsequently, the host controller 104 checks the cue flag buffer to see whether or not the waiting time is equal to or greater than the predetermined time period as by step S405. Even if the user have not generated the tone at the marked point in the principal melody, the delay is admittable in so far as the waiting time is shorter than the predetermined time period. Then, the host controller 104 immediately returns to the main routine program.

On the other hand, if the predetermined time period has been expired, the answer at step S405 is given affirmative, and the host controller 104 assumes that the user skips the note at the marked point in the principal melody either intentionally or unintentionally. Then, the host controller 104 adjusts the pointer time to the target time for the missing note as by step S406.

Upon completion of the adjustment at step S403 or S406, the host controller 104 erases the note number and the flag time from the cur flag buffer, and the waiting time is reset to zero as by step S407. Subsequently, the host controller 104 checks the event buffer to see whether or not the pointer time is equal to any one of the target times stored in the event buffer. If the host controller 104 finds the target time or times equal to the pointer time, the host controller 104 achieves the task or tasks for the piece or pieces of event data as by step S408. If the piece of event data is found in the principal melody track, the host controller 104 determines the target key velocity Vr, and instructs the servo-controller 102*a* to drive the solenoid-operated key actuator 102*b*. If the piece of event data in the track Tr1 has the target time equal to the pointer time, the host, the host controller 104 transfers the music data code to the tone generator/sound system 102*c,* and the tone generator/sound system 102*c* generates the electronic tone for the accompaniment. If the piece of event data in the external control track Tr2 has the target time equal to the pointer time, the host controller 104 transfers the piece of event data through the MIDI cable 111*b* to the local controller 200. Thereafter, the host controller 104 erases the kind of event, the note number and the target time associated with the piece of event data executed at S408 from the event buffer as by step S409. After step S409, the host controller returns to the main routine program.

As described in the previous paragraph, the pieces of event data in the external control track are sequentially transferred to the local controller 200 through the subroutine program S400 (see at step S408). With the piece of event data, the local controller 200 controls the audio-visual system 300 as follows.

Figure 24:
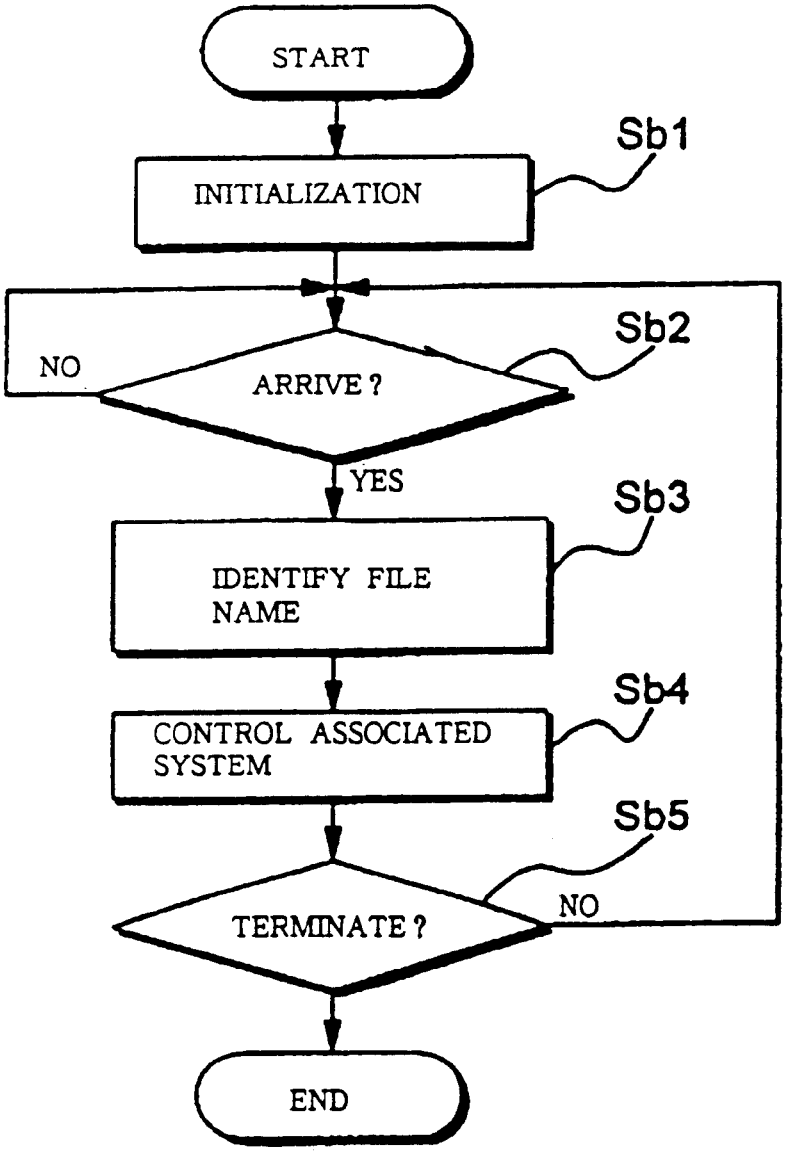
FIG. 24 is a flowchart showing a program sequence executed by a local controller.

FIG. 24 illustrates tasks achieved by the local controller 200. When the local controller 200 is energized, the local controller 200 initializes the registers, butters and flags incorporated therein as by step Sb1. After the initialization, the controller 201 periodically checks the MIDI interface port 202 to see whether or not a MIDI music data code representative of a piece of event data arrives as by step Sb2. If any MIDI music data code does not arrive at the MIDI interface port 202, the answer at step Sb2 is given negative, and the controller 201 periodically checks the MIDI interface port 202 until arrival of the MIDI music data code.

When the host controller 104 transfers the MIDI music data code in the external control track to the local controller 200, the controller 201 finds the MIDI music data code at the MIDI interface port 202, and the answer at step Sb2 is changed to the positive answer. The controller 201 fetches the MIDI music data code. As described hereinbefore, the control data code is stored in the storage area assigned to the note number forming a part of the MIDI music data code. The control data code is described in the same format as the bit string representative of the note number. The controller 201 compares the control data code with the note numbers in the table 203, and identifies the file name as being requested by the control data code as by step Sb3. The controller 201 notifies the file name and the database 211, 212 or 213 to the associated controller 221, 222 or 223, and the controller 221, 222 or 223 controls the associated system 301, 302 or 303 in accordance with the instructions stored in the file as by step Sb4. The controller 201 checks the internal register to see whether or not the control data "END" has been received as by step Sb5. If the answer is negative, the ensemble has not been terminated, and the controller 201 returns to step Sb2. Thus, the controller 201 reiterates the loop consisting of steps Sb2 to Sb5 until the control data "END" arrives at the MIDI interface port 202, and the three controller 221/222/223 independently controls the stage lighting system 301, the image producing system 302 and the sound system 303. When the controller 201 receives the control data "END",the answer at step Sb5 is changed to positive, and the controller 201 terminates the control sequence.

As will be understood, the electronic synchronizer according to the present invention controls the keyboard musical instrument 100 and the audio-visual system 300 by using a set of multi-track music data codes such as, the MIDI musical data codes. Although the multi-track music data codes are formatted for musical instruments, the electronic synchronizer according to the present invention has the table 203 for converting the pieces of musical data information to the pieces of control data information for the audio-visual system. For this reason, the data format for the musical instrument is available for controlling the audio-visual system.

The cue flag is stored in the particular music data codes, and the electronic synchronizer synchronizes the audio-visual system 100 and the keyboard musical instrument 300 with the voice of a singer or the tone generated by an acoustic piano at the points marked with the cue flags. Thus, the electronic synchronizer according to the present invention achieves the synchronization between more than two parts. If the microphone picks up the acoustic piano notes generated from the keyboard musical instrument, the ensemble system according to the present invention is used as a training system for a beginner.

Although particular embodiments of the present invention have been shown and described, it will be apparent to those skilled in the art that various changes and modifications may be made without departing from the spirit and scope of the present invention.

For example, the cue flag may be stored in another storage area of a piece of event data such as, for example, a header. A MIDI message such as an exclusive or the storage area assigned to the velocity may be assigned to the control data codes for the audio-visual system. A track may be assigned to the cue flag. The synchronous points may be represented by another kind of control data such as, for example, pieces of control data information representative of bars in a score or pieces of control data information representative of rests in a score. Otherwise, an electronic synchronizer according to the present invention counts the notes, and makes the musical instrument and another kind of instrument synchronous with the fingering at intervals of a predetermined number of notes.

The multi-track music data codes may be produced in accordance with another music standard.

The electronic synchronizer may retard or accelerate the execution of pieces of event data representative of the principal melody track. In the first embodiment, the pointer time is shared between the principal melody track and the external control track. This means that the temporary rest has the influence on both tracks. In another electronic synchronizer according to the present invention, the principal memory track is immediately rest at entry into the waiting status, but the eternal control track is rest after a predetermined time. The electronic synchronizer may retard the external control track.

The piece of event data exits from the waiting status when thee predetermined time period is expired. Another electronic synchronizer may unconditionally wait for the detection of the depressed key.

In the first embodiment, when a trainee depresses the key before the target time, the electronic synchronizer transfers the associated piece of event data to the local controller 200 also earlier than the target time. Another electronic synchronizer may transfer the associated piece of event data at the target time in so far as the difference between the flag event and the target time is fallen within a predetermined short time period. In this instance, the pointer time is continuously incremented.

The solenoid-operated key actuators 102*b* may not guide a trainee in the ensemble mode.

A keyboard musical instrument according to the present invention may further comprise an array of optical indicators respectively associated with the black/white keys 101*f*/101*f*. In this instance, the host controller 104 sequentially illuminates the optical indicators instead of the actuation of the solenoid-operated key actuators 102*b* for guiding a trainee.

Three tracks may be assigned the three file groups. For example, a track Trx, another track Tr(x+1) and yet another track Tr(x+2) are respectively assigned the MIDI music data codes for designating the three file groups. In this instance, the files for each component of the audio-visual system are drastically increased. Moreover, more than one track may be assigned the MIDI music data codes for designating one of the three file groups.

The electronic synchronizer according to the present invention may synchronizes another kind of instrument such as, for example, an air conditioner, a fan and/or a fragrance generator with manipulation on a musical instrument.

The data stored in the databases 211/212/213 are organized in any standards. The database 212 and the data in the database 213 may contain MPEG (Moving Picture Experts Group) data and ADPCM (Adaptive Differential Pulse Code Modulation) data. Of course, MIDI data codes are available for the database 213.

Another kind of musical instrument may be controlled by the electronic synchronizer according to the present invention. The musical instrument may be another kind of keyboard musical instrument such as, for example, an electric keyboard or an organ, a wind instrument, a string instrument or a percussion instrument.

Any kind of sensor is available for detecting the fingering. Pedal sensors may be connected to the electronic synchronizer according to the present invention.

Plural local controller may form the electronic synchronizer together with the host controller. Otherwise, the local controller 200 may be installed inside of the musical instrument.

The computer programs may be loaded into the host controller from the outside through a communication line or an information storage medium.

A set of music data codes may have the principal melody track, only. In this instance, any track is not assigned to the music data codes representative of an accompaniment. The cue flag is stored in selected music data codes, and the tone generator/sound system 102*c* generates electronic tones only when the user depresses the black/white keys 101*f*/101*g* or generates the tone at the marked points on the score. If the waiting time is expired before the fingering or the arrival of MIDI music data code at the marked point, the host controller 104 stops the electronic tones. In case where the MIDI data generator converts singer's voice to the MIDI music data codes, the tone generator/sound system 102*c* generates the principal melody along the music score.

In the second embodiment, the host controller 104 stops the plungers at certain points before the escape of the associated jacks. Another ensemble system may fully project the plungers for actuating the action mechanisms 101*b*. The hammers 101*c* are driven for rotation toward the music strings 101*e*, and the acoustic piano tones are generated. On the contrary, the host controller 104 may not instruct the servo-controller to energize the solenoidoperated key actuators 102*b*. In this instance, the principal melody track is used for the synchronization, only, and the tone generator/sound system 102*c* generates the electronic tones for the accompaniment. The host controller 104 may instruct the servo-controller 102*a* to energize the solenoid-operated key actuators 102*b* for the accompaniment.

The cue flag may be stored in music data codes in the track assigned to the accompaniment. In this instance, the tone generator/sound system 102*c* generates the electronic tones along the principal melody.

The MIDI data generator 28 may be replaced with a source of voice/audio signal generator. In this instance, the voice/audio signal generator supplies a voice/audio signal to the host controller 104, and the host controller extracts pieces of music data information representative of the pitches from the voice/audio signal. An input port for the voice/audio signal is required for the host controller 104. The MIDI data generator 28 may be incorporated in the host controller 104 for extracting the pieces of music data information.

Another electronic synchronizer according to the present invention may control another kind of instrument such as, for example, the audio-visual system on the basis of the fingering on the keyboard 101*a* in a synchronous control mode. The key sensors 103*a* may monitor the fingering, and the host controller may reiterate the control loop shown in FIG. 21. The synchronous control mode may be added to the keyboard musical instrument implementing the first/second embodiment.

What is claimed is:

1. A synchronizer for synchronizing a kind of instrument used for a purpose different from music with another kind of instrument used for producing a series of tones, comprising:

a first data source storing a first piece of sequence data including pieces of synchronous data at intervals in a first data group and a second piece of sequence data including pieces of music data in a second data group and available for said another kind of instrument in order to produce another series of tones, and synchronously outputting said first piece of sequence data and said second piece of sequence data;

a second data source successively outputting pieces of reference data representative of an actual performance;

a converter for converting said pieces of music data to instructions for tasks to be achieved by said kind of instrument;

a first controller connected to said first data source, said second data source and said converter, and comparing said pieces of synchronous data with certain pieces of reference data corresponding thereto for transferring said pieces of music data to said converter in synchronism with said certain pieces of reference data; and a second controller connected to said converter and said kind of instrument, and driving said kind of instrument in response to said instructions.

2. The synchronizer as set forth in claim 1, in which said second data source is incorporated in said another kind of instrument.

3. The synchronizer as set forth in claim 2, in which said second data source is implemented by an array of sensors for producing electric signals representative of fingering on said another kind of instrument.

4. The synchronizer as set forth in claim 3, in which said another kind of instrument includes a keyboard on which a player fingers.

5. The synchronizer as set forth in claim 1, in which said pieces of synchronous data are respectively associated with selected ones of other pieces of music data forming parts of said first piece of sequence data, and said other pieces of music data represent a music passage to be traced through said actual performance.

6. The synchronizer as set forth in claim 5, in which said pieces of music data and said other pieces of music data are stored in a set of music data codes and another set of music data codes, and said set of music data codes and said another set of music data codes are formatted in accordance with a predetermined standards.

7. The synchronizer as set forth in claim 6, in which said predetermined standards are MIDI (Musical Instrument Digital Interface) standards, and said first data group and said second data group are corresponding to one of the tracks and another of said tracks.

8. The synchronizer as set forth in claim 5, in which said pieces of synchronous data are stored in said selected ones of said other pieces of music data in the form of flag.

9. The synchronizer as set forth in claim 5, in which said another kind of instrument guides a user in said performance along said music passage on the basis of said other pieces of music data.

10. The synchronizer as set forth in claim 1, in which said second data source includes another converter for extracting said pieces of reference data from an analog signal.

11. The synchronizer as set forth in claim 10, in which said second data source is provided outside of said another kind of instrument.

12. The synchronizer as set forth in claim 10, in which said analog signal is representative of a voice.

13. The synchronizer as set forth in claim 10, in which said analog signal is representative of a performance on an acoustic musical instrument.

14. The synchronizer as set forth in claim 1, in which said kind of instrument includes at least a lighting system for varying at least one light beam radiated therefrom in synchronism with said pieces of reference data.

15. The synchronizer as set forth in claim 1, in which said kind of instrument includes at least an image producing system for producing at least one of static picture and moving picture in synchronism with said pieces of reference data.

16. The synchronizer as set forth in claim 1, in which said kind of instrument includes at least a sound system for producing sound effects in synchronism with said pieces of reference data.

17. The synchronizer as set forth in claim 5, in which said pieces of music data are linked with said other pieces of music data by using target times at which said pieces of music data and said other pieces of music data are read out from said first data source in synchronism with one another.

18. A method for synchronizing a kind of instrument used for a purpose different from music with another kind of instrument used for producing a series of tones, comprising the steps of:

a) preparing a first piece of sequence data including pieces of synchronous data and stored at intervals in a first data group and a second piece of sequence data including pieces of music data, stored in a second data group and available for said another kind of instrument in order to produce another series of tones;

b) receiving one of pieces of reference data;

c) comparing said one of pieces of reference data with one of said pieces of synchronous data to see whether or not said one of pieces of reference data arrives within a predetermined time period around a target time when said one of said pieces of synchronous data is to be processed;

d) transferring associated one of said pieces of music data to a converter in synchronism with said one of said pieces of reference data for converting said associated one of said pieces of music data to instructions for said kind of instrument when the answer in said step c) is given affirmative;

e) controlling said kind of instrument in accordance with said instructions; and f) repeating said steps b), c), d) and e) for each of the remaining pieces of reference data.

19. The method as set forth in claim 18, in which said pieces of synchronous data are linked with other pieces of music data representative of a music passage to be performed, and said pieces of reference data are representative of a performance on said another kind of instrument, and in which said one of said piece of synchronous data and said one of said reference data are checked to see whether or not said one of said piece of synchronous data and said one of said reference data are indicative of a certain node in said step c).

20. The method as set forth in claim 18, in which said one of said pieces of music data is transferred to said converter as if said one of said piece of reference data arrives at a target time in said predetermined time period when the answer at step c) is given negative.

* * * * *